US006896554B2

(12) United States Patent
Beideman

(10) Patent No.: US 6,896,554 B2
(45) **Date of Patent: *May 24, 2005**

(54) SAFETY DEVICE FOR ELECTRICAL APPARATUS OR APPLIANCES

(75) Inventor: Gary S. Beideman, West Chester, PA (US)

(73) Assignee: Lasko Holdings, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/771,953

(22) Filed: Feb. 4, 2004

(65) Prior Publication Data

US 2004/0224561 A1 Nov. 11, 2004

Related U.S. Application Data

(63) Continuation-in-part of application No. 10/454,308, filed on Jun. 4, 2003, now Pat. No. 6,793,535, which is a continuation-in-part of application No. 10/135,054, filed on Apr. 29, 2002, now Pat. No. 6,604,965, which is a continuation of application No. 09/689,977, filed on Oct. 13, 2000, now Pat. No. 6,394,848.

(51) Int. Cl.[7] ..... H01R 13/68
(52) U.S. Cl. ..... 439/622; 439/606
(58) Field of Search ..... 439/622, 606, 439/411, 621, 412, 417, 620, 893

(56) References Cited

U.S. PATENT DOCUMENTS

| | | | |
|---|---|---|---|
| 4,208,645 | A | 6/1980 | Harmon et al. |
| 5,249,986 | A | 10/1993 | Lu |
| 5,424,895 | A | 6/1995 | Gaston |
| 5,814,775 | A | 9/1998 | Chou |
| 5,876,250 | A | 3/1999 | Deng |
| 5,924,888 | A | 7/1999 | Larkin |
| 6,394,848 | B1 | 5/2002 | Beideman |
| 2002/0119703 | A1 | 8/2002 | Beideman |

FOREIGN PATENT DOCUMENTS

FR 2 802 721 A1 6/2001

OTHER PUBLICATIONS

PCT International Search Report for PCT International Application No. PCT/US2004/014860 mailed Nov. 3, 2004.

*Primary Examiner*—Ross Gushi
*Assistant Examiner*—Phuongchi Nguyen
(74) *Attorney, Agent, or Firm*—RatnerPrestia

(57) ABSTRACT

A safety device for use with an electric apparatus is provided. The safety device includes a housing and at least two terminals disposed at least partially within the housing. The safety device also includes a cord set having at least two conductors. A first end of the two conductors is mounted at least partially within the housing. The safety device also includes a non-replaceable circuit interrupter disposed within the housing so as to be inaccessible to a user and coupled between i) one of the at least two terminals and ii) one of the at least two conductors of the cord set.

20 Claims, 26 Drawing Sheets

FUSED PLUG DETAIL
FUSED PLUG
HOT IN (SMOOTH WIRE)
NEUTRAL (RIBBED WIRE)
CORDSET (SMOOTH WIRE)
CORDSET (RIBBED WIRE)
ROTORY SWITCH (3 SPEED) (VIEW FROM TOP)
SPLICE
4 uF 250 WVAC
WHITE
BLACK
BROWN
RED
OFF
HIGH
LOW
THERMAL CUTOFF
ELECTRICAL SCHEMATIC

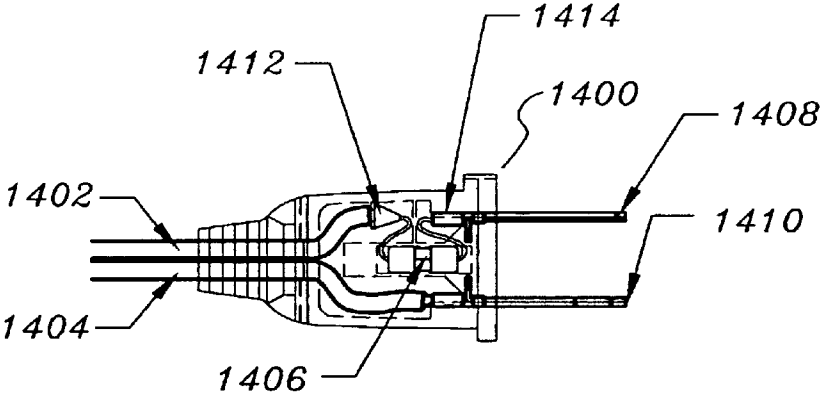
FIG. 14A
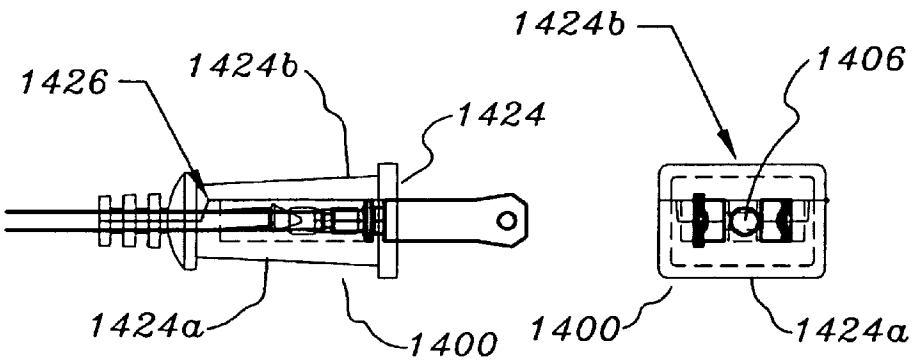
FIG. 14C
FIG. 14B
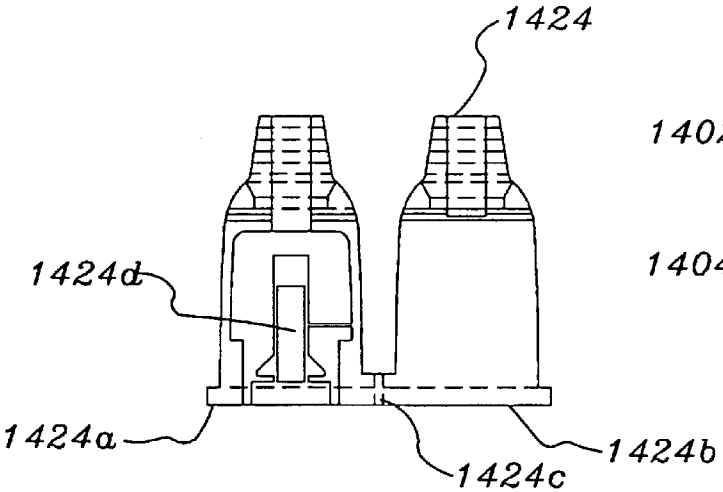
FIG. 14D
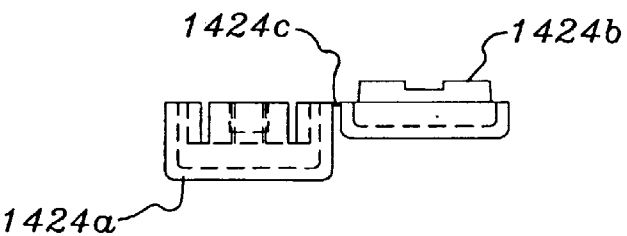
FIG. 14E

SAFETY DEVICE FOR ELECTRICAL APPARATUS OR APPLIANCES

This application is a continuation in part of U.S. patent application Ser. No. 10/454,308, filed Jun. 4, 2003 now U.S. Pat. No. 6,793,535, which is a continuation in part of U.S. patent application Ser. No. 10/135,054, filed Apr. 29, 2002, now U.S. Pat. No. 6,604,965 issued Aug. 12, 2003, which is a continuation of U.S. patent application Ser. No. 09/689,977, filed Oct. 13, 2000, now U.S. Pat. No. 6,394,848 issued May 28, 2003.

FIELD OF THE INVENTION

This invention relates to a safety device for an electrical apparatus or appliance, and more particularly to a safety device including a non-replaceable circuit interrupter.

BACKGROUND OF THE INVENTION

Air moving apparatus (e.g., electric fans), appliances including a motor, or devices including electric heating elements are potentially subject to electrical problems due to accident, misuse, excessive moisture and/or heat, which can cause the wiring in a motor, the cord set, or other wires to short. Motors in appliances often incorporate a thermal cut-off device which reacts to an increase in heat to shut off the motor. Thermal devices are generally slow acting and designed to sense and react to a gradual heat increase. The heat increase can be caused by a variety of factors such as a slow acting short in the motor windings, or a bearing failure resulting in reduced air flow. Such factors may cause the winding temperature to rise.

Thermal devices are most effective at sensing localized heating, and as such, if a failure occurs at a location remote from the thermal device, the thermal device may not sense the condition quickly enough to shut the motor down prior to failure. As such, rapidly acting remote failures may result in damage to the electric device (i.e., the electrical apparatus) before the thermal device operates.

Faults that occur in appliances and electrical devices produce heat by friction, arcing, and resistive heating. The faults, and thus the sources, may occur in combination. For example, in an appliance or electrical device that utilizes an electric motor, frictional heating acts to cause bearing failure. Bearing failure acts to cause rotor lockup, and rotor lockup acts to cause inductive heating. The inductive heating breaks down insulation and causes arcing.

A properly sized circuit interrupter (e.g., a fuse) will react to rapid failure conditions and/or an increase in current over its capacity. Such a circuit interrupter will protect components upstream from the motor, such as the cord set. A circuit interrupter will also react to shorts internal to the switch, lead wires, and motor windings. A circuit interrupter, to be effective, should preferably be non-replaceable in order to insure that the user does not defeat the purpose of the circuit interrupter, which is to enhance safety of the thermal cut-off device thus preventing damage to components, the apparatus, or the appliance. In addition, the combination of these two devices (i.e., the thermal device and the circuit interrupter) in an electrical apparatus or appliance will further enhance the safety of the apparatus or appliance as well as act to protect its components.

SUMMARY OF THE INVENTION

According to an exemplary embodiment of the present invention, a safety device for use with an electric apparatus is provided. The safety device includes a housing and at least two terminals disposed at least partially within the housing. The safety device also includes a cord set having at least two conductors. A first end of the two conductors is mounted at least partially within the housing. The safety device also includes a non-replaceable circuit interrupter disposed within the housing so as to be inaccessible to a user and coupled between i) one of the at least two terminals and ii) one of the at least two conductors of the cord set. Additionally, the safety device includes at least one control component electrically connected to one of said at least two conductors.

The safety device of the present invention may be, for example, a fused cord set plug. Further, the non-replaceable circuit interrupter may be a fuse included in the cord set plug.

The present invention provides an enhanced safety device to protect an electrical apparatus or appliance from damage due to excessive heat or shorts. Further, the present invention provides an enhanced safety device that is fast and positive in operation. Further still, the present invention provides an enhanced safety device as aforesaid that is useful with a wide variety of electrical apparatus or appliances, wherein the appliances may have inductive, capacitive, or tungsten type loads. A circuit interrupter portion of the enhanced safety device can be matched to the load type by current value and trip characteristics. For example, inductive loads having in rush currents that start low may use a fast trip circuit interrupter. In contrast, tungsten and capacitive loads with higher in rush currents may be designed with a slow acting circuit interrupter.

According to another exemplary aspect of the present invention the safety device comprises a first housing; at least two terminals disposed at least partially within the first housing; a cord set having at least two conductors, a first end of the at least two conductors mounted at least partially within the first housing, the at least two conductors connected to the at least two terminals and exiting the first housing; a second housing located proximate the first housing, the at least two conductors coupled between the first housing and the second housing; and a non-replaceable circuit interrupter disposed within the second housing so as to be inaccessible to a user and connected in series with at least one of the at least two conductors of the cord set.

According to yet another exemplary aspect of the present invention the safety device comprises a housing; at least two terminals disposed at least partially within the housing; a cord set having at least two conductors, a first end of the at least two conductors mounted at least partially within the housing and connected to respective ones of the at least two terminals, the at least two conductors exiting the housing; and a non-replaceable circuit interrupter i) located proximate the housing, ii) disposed within a portion of the cord set and iii) connected in series with one of the at least two conductors of the cord set. The non-replaceable circuit interrupter is disposed within the cord set so as to be inaccessible to a user.

The present invention provides a reliable and manufacturable assembly. The high injection pressures involved with molding plastic around a plug assembly can move the component parts, and potentially create an intermittent or open connection. Through certain embodiments of the present invention, component parts are encapsulated with a housing and a housing cover preventing the invasion of plastic during the molding operation. Further, the present invention provides an enhanced safety device that is no larger than devices typically found in the marketplace, although containing an additional non-replaceable circuit interrupter (e.g., fuse). This may be achieved, for example, by locating the device components in slots and cavities integral to the housing. Further still, the present invention provides an enhanced safety device as aforesaid that is reliable and relatively inexpensive to construct. Further still, the present invention provides an enhanced safety device as aforesaid that enhances the safety of the apparatus or appliance.

Other advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which:

FIG. 2 is a schematic of the apparatus of FIG. 1;

FIG. 14A is a top interior view of a cord set plug assembly in accordance with a sixth exemplary embodiment of the present invention;

FIG. 14B is a side interior view of the cord set plug assembly of FIG. 14A;

FIG. 14C is a front interior view of the cord set plug assembly of FIG. 14A;

FIG. 14D is a top view of a portion of the cord set plug assembly of FIG. 14A;

FIG. 14E is a side view of a portion of the cord set plug assembly of FIG. 14A;

It should, of course, be understood that the description and drawings herein are merely illustrative and that various modifications and changes can be made in the structures disclosed without departing from the spirit and scope of the invention.

Like numerals refer to like parts throughout the several views.

DETAILED DESCRIPTION OF THE INVENTION

The entire disclosure of U.S. patent application Ser. Nos. 10/135,054 and 10/454/308 are incorporated herein by reference as if set forth in full.

When referring to the various exemplary embodiments disclosed herein, certain terminology will be utilized for the sake of clarity. Use of such terminology is intended to encompass not only the described embodiments, but also technical equivalents which operate and function in substantially the same way to bring about the same result.

The present invention may be used in conjunction with a thermal cut-off device in the electrical apparatus being protected, if desired. Use of such a thermal cut-off device is not required nor intended to limit the scope of the present invention.

Figures 1, 3, 7:
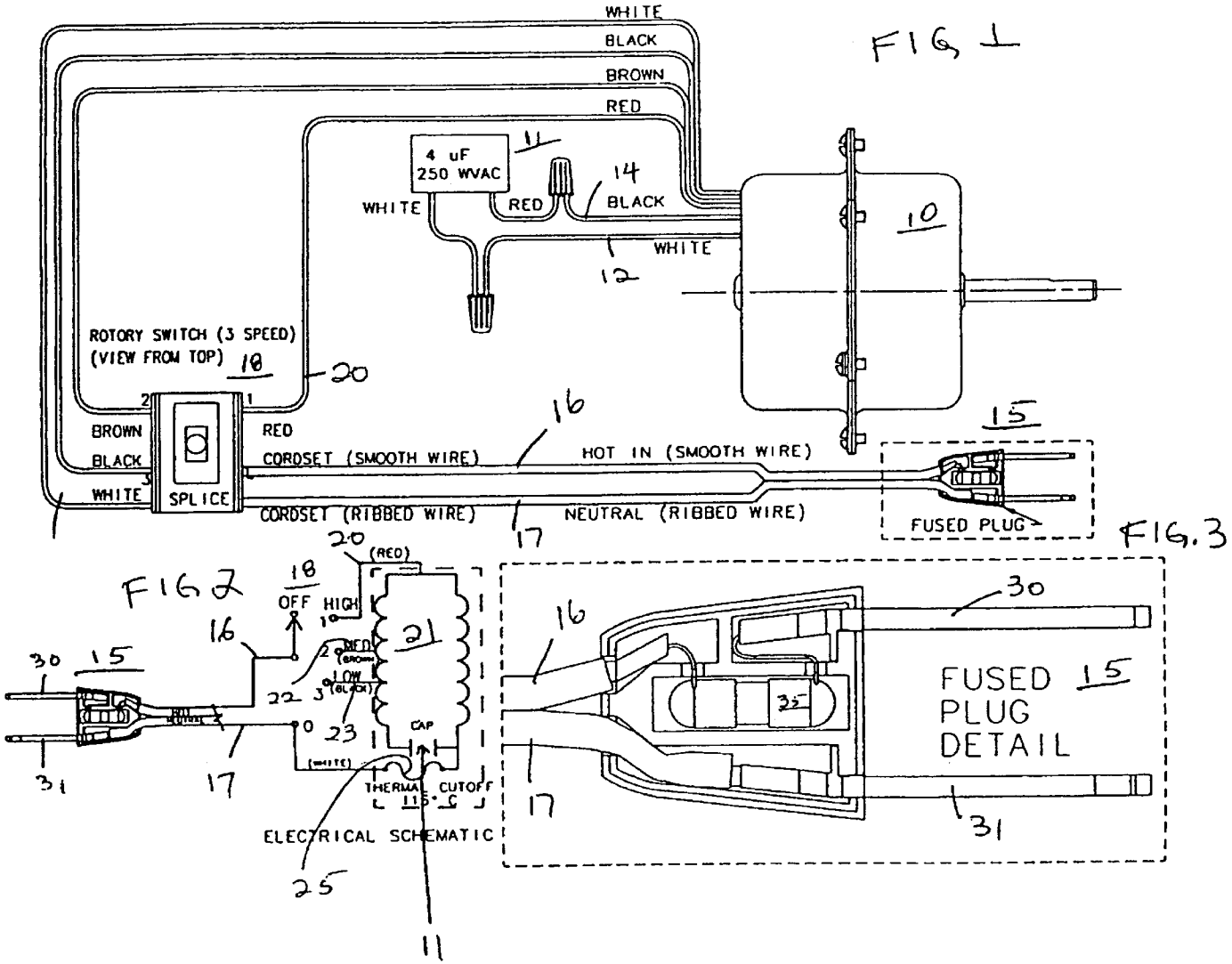
FIG. 1 is a schematic of a safety device as installed in an electrical apparatus having an electric motor in accordance with an exemplary embodiment of the present invention.
FIG. 3 is a detailed plan view of the cord set plug of FIG. 1.
Figure 4:
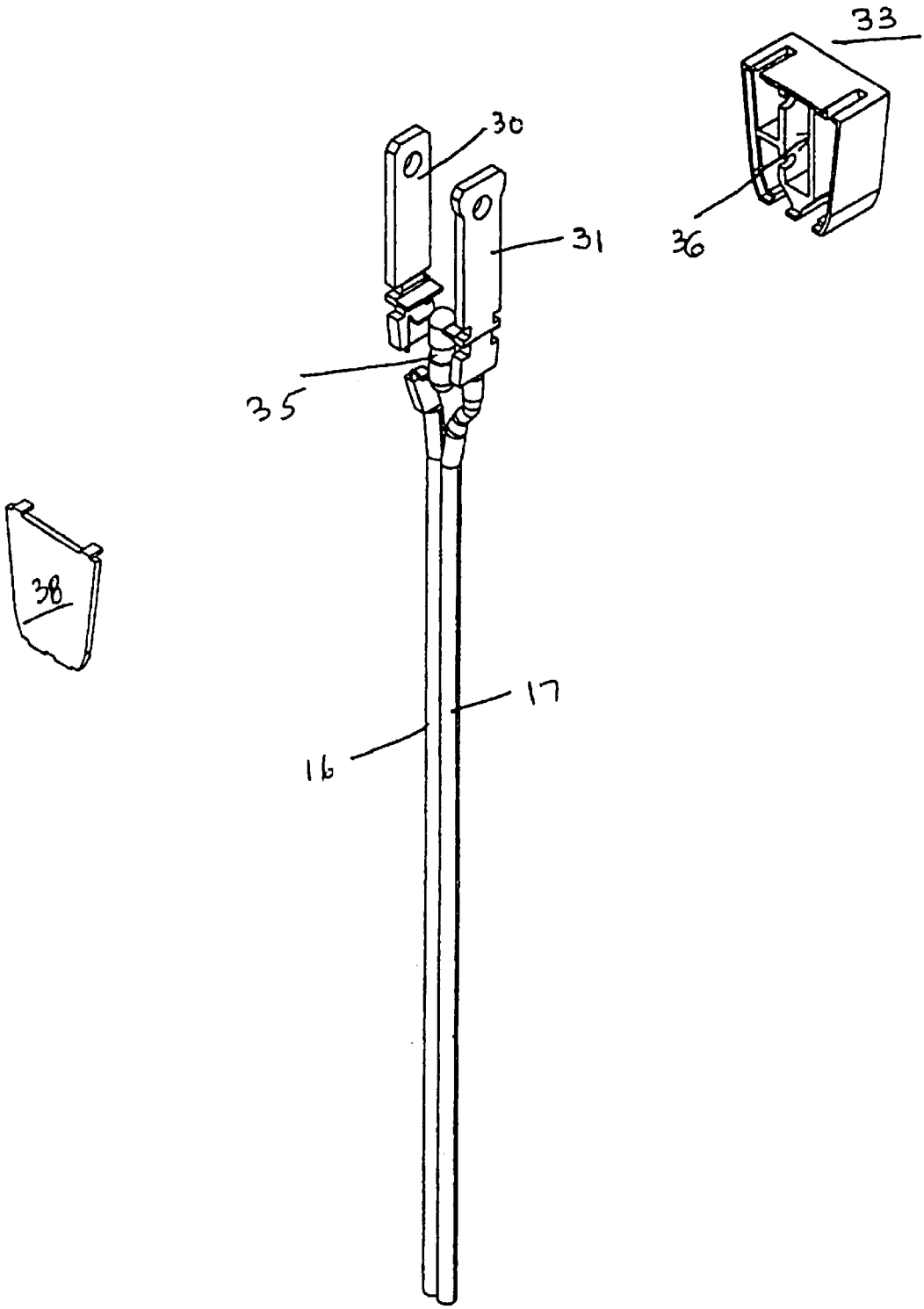
FIG. 4 is an exploded perspective view of a cord set plug in accordance with a first exemplary embodiment of the present invention.
Figure 5:
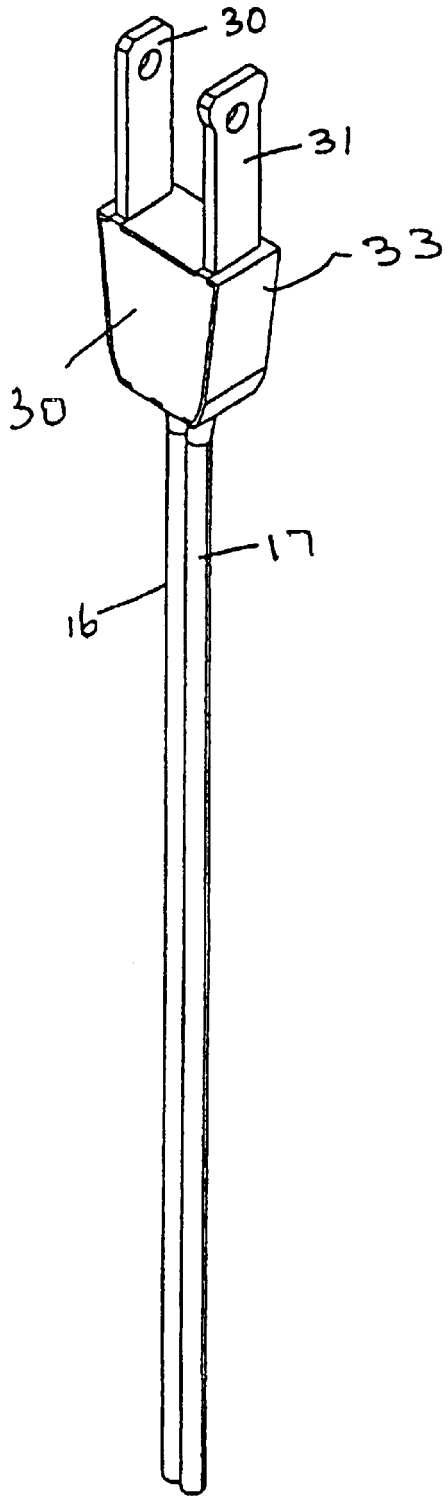
FIG. 5 is a perspective view of a partially assembled cord set plug in accordance with the exemplary embodiment of FIG. 4.
Figure 6:
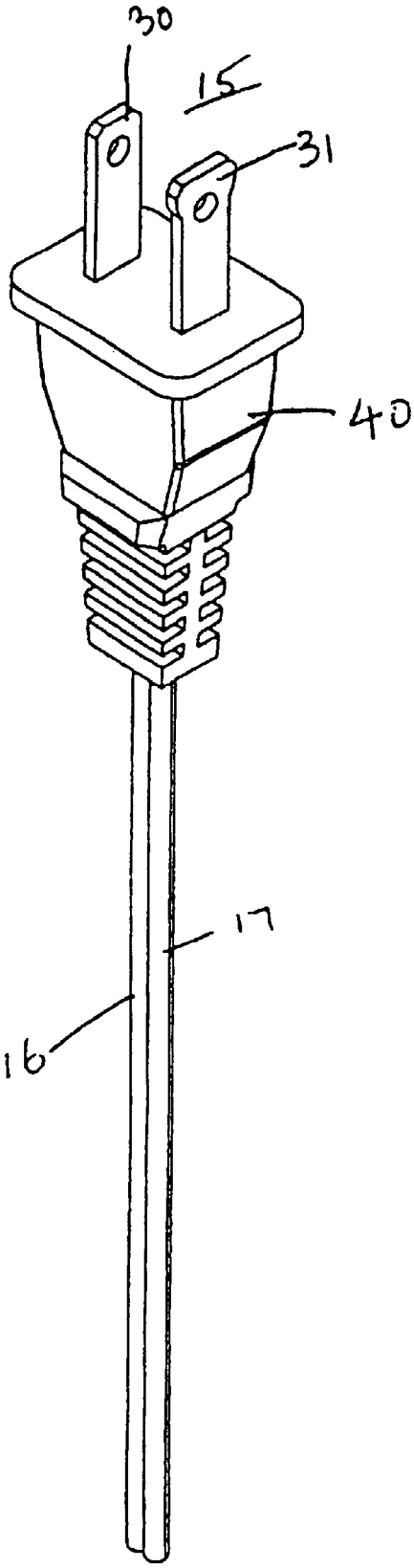
FIG. 6 is a perspective view of a molded cord set plug assembly in accordance with the exemplary embodiment of FIG. 4.

Referring now to FIGS. 1–2, in accordance with an exemplary 15 embodiment of the present invention, an enhanced safety device combination is therein illustrated, as used with an electric motor 10 of a well known type. The motor 10 has a capacitor 11 of a well known type in series therewith and connected thereto by wires 12 and 14.

A cord set plug 15 is provided to be connected to a source of electrical energy (not shown), and has a hot (positive) wire 16 and a neutral wire 17 connected thereto. Positive wire 16 and neutral wire 17 are also connected to a multi-position rotary switch 18 of a well known type, illustrated as a three speed switch, which may or may not be included in the present invention. The switch 18 has a high speed wire 20 connected thereto and to motor windings 21, a medium speed wire 22 connected thereto and to motor windings 21, and a low speed wire 23 connected thereto and to motor windings 21.

The neutral wire 17 is also connected from switch 18 to the motor windings 21 through optional thermal cut-off device 25. The thermal cut-off device 25 as illustrated will be activated by a rise in temperature, and will open the circuit to cut-off the motor 10, and may be of a single use or of a reset type, as desired.

Referring now additionally to FIGS. 3–6, the cord set plug 15 includes two spades 30 and 31 (terminals 30,31) of a well known type, with spade 31 connected to neutral wire 17 and engaged in recess 32 of a plug cover 33. The cover 33 is preferably of molded plastic and open at one side. The spade 30 is engaged in recess 34 of cover 33 and connected to a fuse 35 of a well known type. Fuse 35 is rated at the desired current capacity and engaged in recess 36 of cover 33, and connected to hot wire 16. A cap 38 is provided which snaps into cover 33, and a continuous layer 40, preferably of plastic applied in a mold (not shown) encapsulates cover 33 and cap 38, making the fuse 35 substantially inaccessible to the consumer. By inaccessible, the inventor means that the user in unable to easily gain access to the circuit interrupter without disassembling, modifying or destroying the housing of plug set 15.

The mode of operation will now be pointed out. In use, the cord set plug 15 is connected to a source of electrical energy (not shown). When desired the apparatus is energized by rotating switch 18, thereby activating motor 10. Should the motor windings 21 overheat, in a thermally protected apparatus the thermal cut-off device 25 will be activated and the motor 10 will be shut down.

Should there be a failure of the system remote from the thermal cut-off device or in an impedance protected apparatus (the inherent resistance of the device limits overheating), the current will rise rapidly, fuse 35 will blow, and the current flow through wire 16 will be broken thereby shutting down motor 10.

While the combination is illustrated in connection with an electric motor, it can be used with other electrical apparatus such as an air moving device, a heater, or any appliance or apparatus where protection is desired.

A benefit of the present invention is that failures of electrical devices are interrupted faster than with existing protection mechanisms. More specifically, by including a non-replaceable circuit interrupter within the safety device, an electrical fault or failure of the electrical apparatus is interrupted quickly. Further, because the circuit interrupter is non-replaceable, a user is unable to immediately re-energize the electrical device.

Figure 7A:
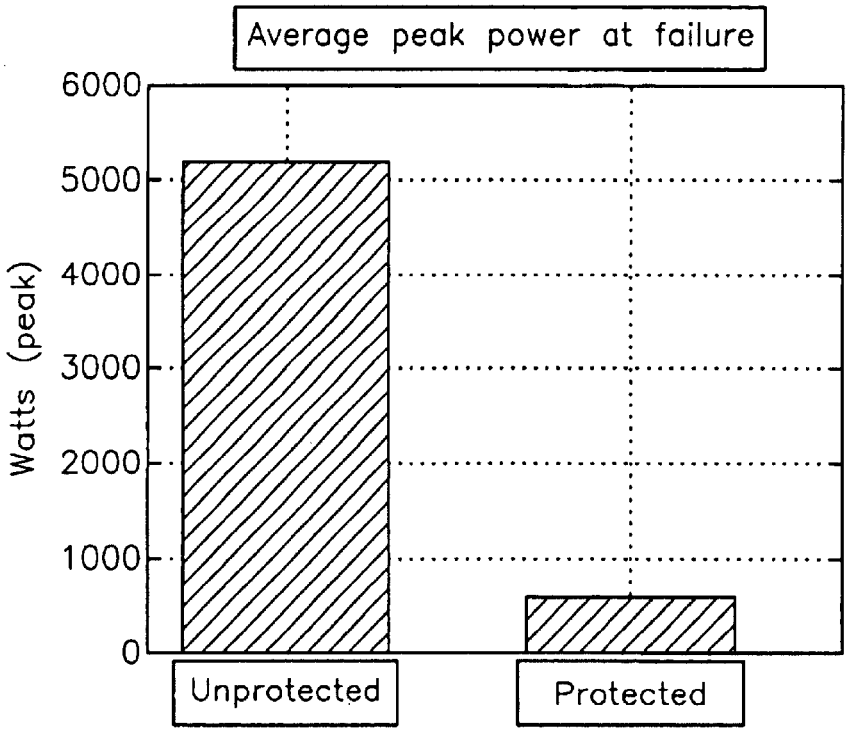
FIG. 7A is a bar chart illustrating the peak power of a protected and unprotected electrical apparatus at failure in accordance with an exemplary embodiment of the present invention.

FIG. 7A is a chart comparing average peak power drawn by an electrical device (protected and unprotected) during a failure. In this example, the unprotected electrical device had an average peak power of 5,000 watts at failure. The same electrical device, including a safety device (e.g., a fused cord set plug) according to the present invention, had an average peak power of about 600 watts at failure. As such, the present invention reduces the average peak power during failure of any electrical device, thus reducing the magnitude of the failure.

Figure 7B:
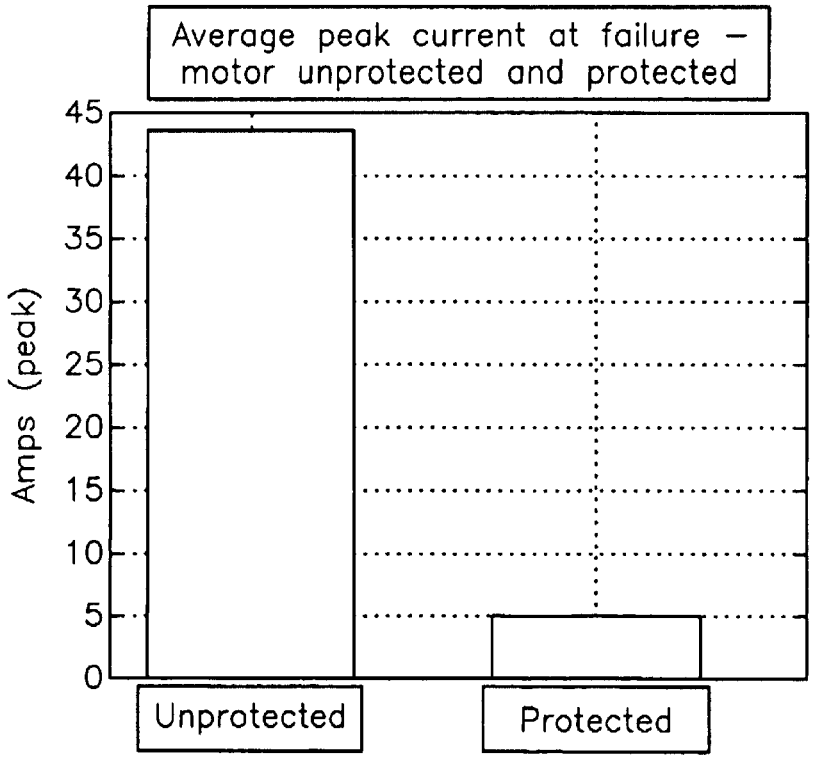
FIG. 7B is a bar chart illustrating the peak current of a protected and unprotected electrical apparatus at failure in accordance with an exemplary embodiment of the present invention.

FIG. 7B is a chart comparing average peak current drawn by an electrical device (protected and unprotected) during a failure. As illustrated in this chart, the unprotected electrical device had an average peak current of about 43.5 amps at failure. Such an average peak current may result in arcing and failed motor windings in an electric apparatus including a motor. The same electrical device including a safety device according to the present invention had an average peak current of about 5 amps at failure. Such a safety device (e.g., a fused cord set plug) limits both the magnitude and duration of over-current faults. As such, the present invention reduces the average peak current during failure of the electrical device.

For example, the results illustrated in FIGS. 7A and 7B were produced by breakdown of the field windings of an electric motor, more specifically, a breakdown of the magnetic wire insulation. The safety device limits both the peak power and peak current as illustrated. Of course, the sizing and selection of characteristics of the safety device are important. For example, in a given application, a fuse rated at less than or equal to 6 amps may be selected for the circuit interrupter. Further, the non-replaceable circuit interrupter (e.g., a fuse) of the safety device may be selected based on a fault requirement of the electrical apparatus, an inrush current of the electrical apparatus, a steady state load of the electrical apparatus, load spikes based on operational conditions of the electrical apparatus, or an auto transformer effect of the electrical apparatus.

Figure 8A:
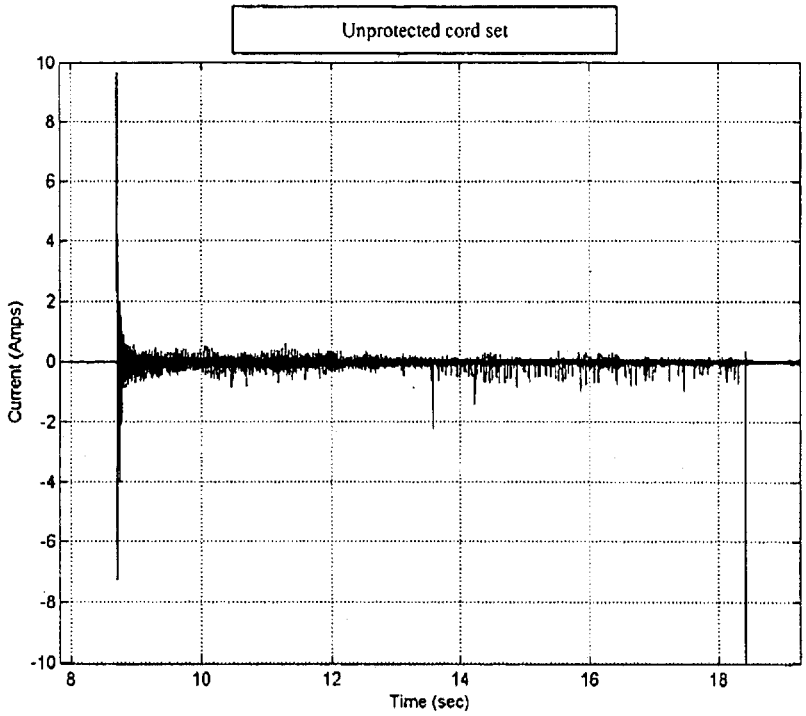
FIG. 8A is a diagram illustrating the current profile of an electrical cord set that is subjected to a failure mode without the benefit of the protection afforded by the present invention.
Figure 8B:
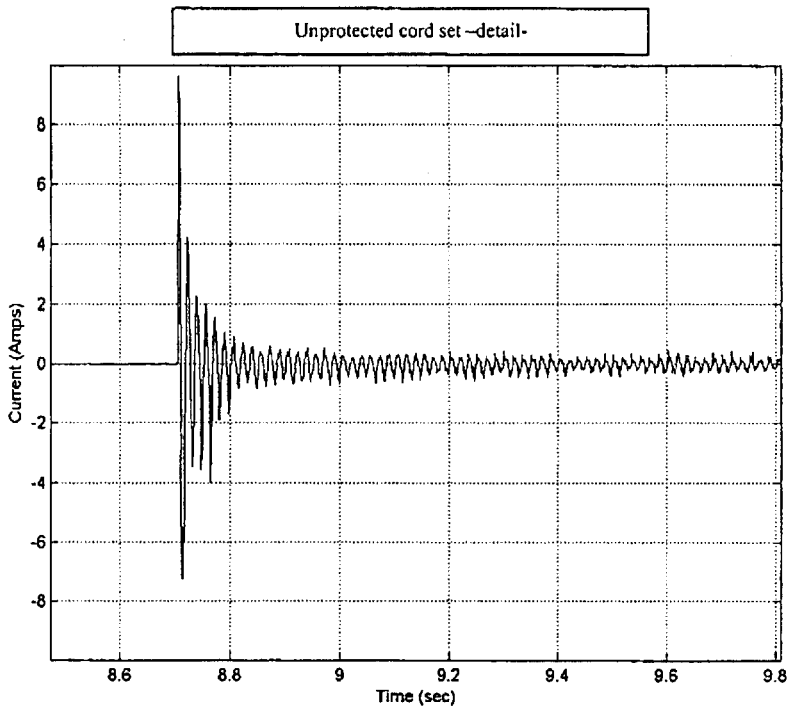
FIG. 8B is a detail of a portion of the diagram illustrated in FIG. 8A.

FIG. 8A is a graph illustrating a current profile of a cord set subjected to a failure mode, specifically a failure based on a charred cord set into which a saline solution is sprayed, otherwise known as "wet arcing." The device under test in FIG. 8A does not include a safety device in its cord set plug. As made clear by the illustration in FIG. 8A, there are numerous current peaks shown in the current profile and the fault lasted approximately 10 seconds, with current peaks approaching and in one case exceeding 10 Amps. FIG. 8B is a detail of a portion of the duration of the fault illustrated in FIG. 8A. Through this portion of the duration of the fault illustrated in FIG. 8B, the many current peaks are more clearly illustrated.

Figure 9A:
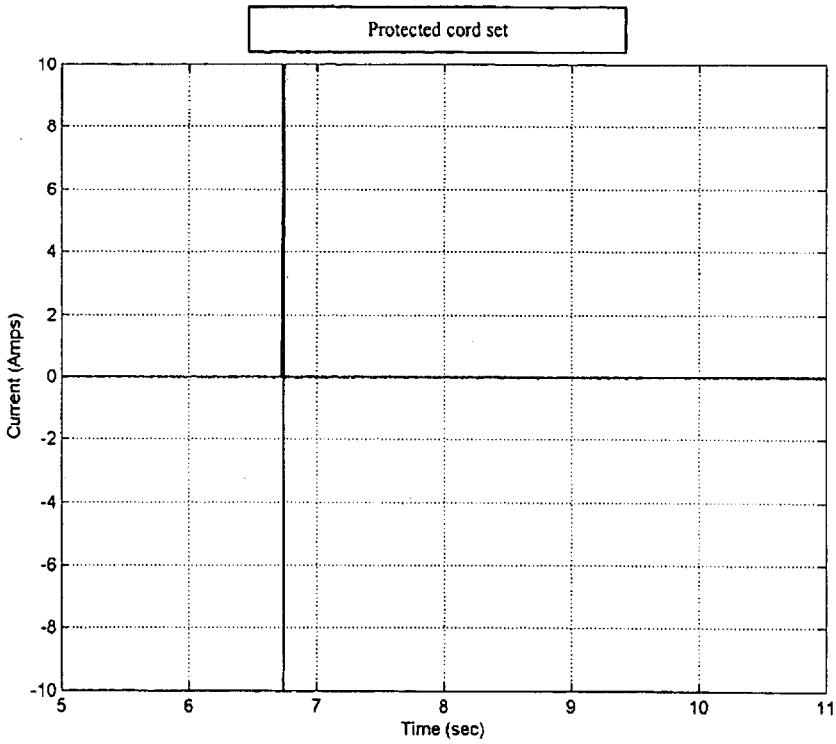
FIG. 9A is a diagram illustrating the current profile of an electrical cord set that is subjected to a failure mode, but having the benefit of a protected cord set plug in accordance with an exemplary embodiment of the present invention.
Figure 9B:
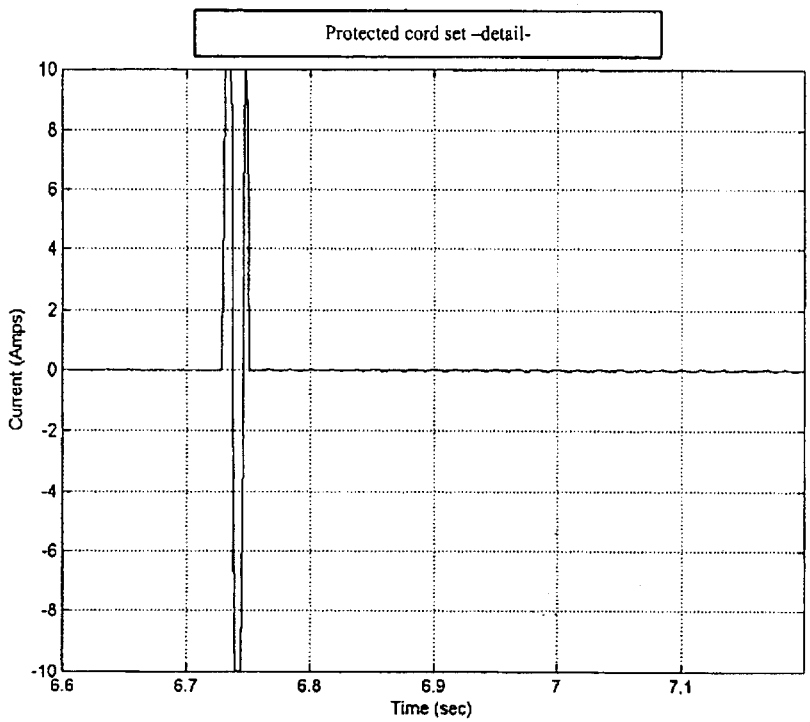
FIG. 9B is a detail of a portion of the diagram illustrated in FIG. 9A.

FIG. 9A is a graph illustrating a current profile of another cord set subjected to a failure mode similar to that of the cord set of FIG. 8A. In this example, however, the cord set is protected with a safety device according to an exemplary embodiment of the present invention. As illustrated in FIG. 9B, although there are current peaks of about 10 Amps, the failure was limited to 20 milliseconds. This is significantly less that the multi-second duration of the current profile illustrated above in FIGS. 8A–8B for an unprotected cord set.

Figure 10A:
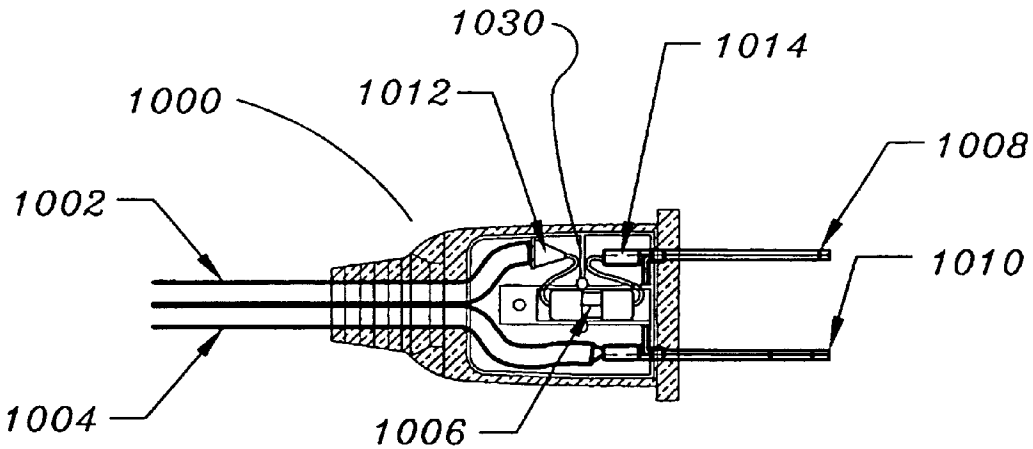
FIG. 10A is a top interior view of a cord set plug assembly in accordance with a second exemplary embodiment of the present invention.
Figure 10B:
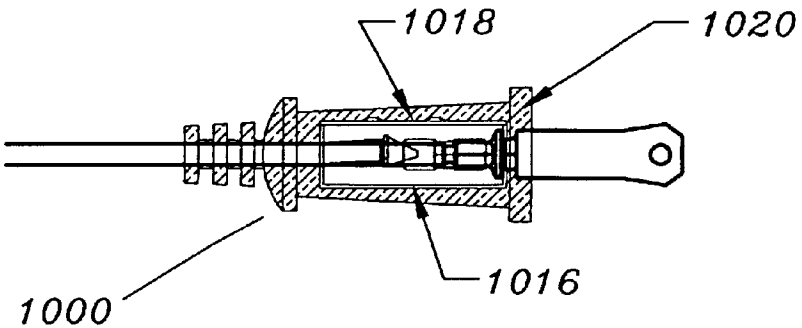
FIG. 10B is a side interior view of the cord set plug assembly of FIG. 10A.
Figure 10C:
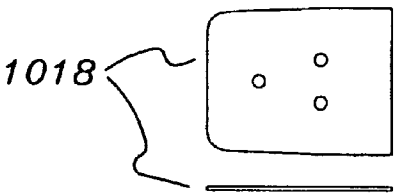
FIG. 10C is a top view and a side view of a housing cover of the cord set plug assembly of FIG. 10A.
Figure 10D:
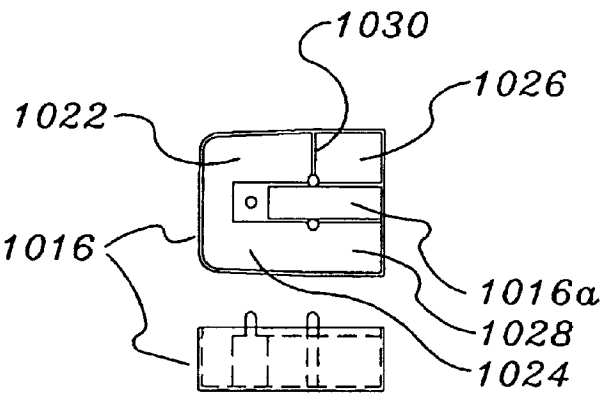
FIG. 10D is a top view and a side view of a housing body of the cord set plug assembly of FIG. 10A.

FIG. 10A provides an interior view of safety device 1000 (e.g., fused cord set plug assembly 1000) according to an exemplary embodiment of the present invention. Safety device 1000 includes conductors 1002 and 1004 that are electrically connected to terminals 1008 and 1010. Conductor 1002 is electrically connected to terminal 1008 through connector 1012, circuit interrupter 1006, and connector 1014. Connectors 1012 and 1014, for example, may be crimp connectors. FIG. 10B is a side view of safety device 1000. As shown in FIG. 10B, safety device 1000 includes housing body 1016, housing cover 1018, and cover 1020 (e.g., over mold cover 1020). Connector 1012, circuit interrupter 1006, and connector 1014 are housed within housing body 1016 and housing cover 1018. FIG. 10C provides a top view and a side view of an exemplary housing cover 1018. FIG. 10D provides a top view and a side view of an exemplary housing body 1016. As shown in FIG. 10*d*, housing body 1016 defines a cavity 1016*a* to house circuit interrupter 1006. Housing body 1016 also defines channels 1022 and 1024, and recesses 1026 and 1028. Channel 1022 is configured to receive a portion of conductor 1002, and channel 1024 is configured to receive a portion of conductor 1004. Recess 1026 is configured to receive a portion of terminal 1008, and recess 1028 is configured to receive a portion of terminal 1010. Side wall 1030 provides additional separation (e.g., insulation) between conductor 1002 (and connector 1012) and terminal 1008 (and connector 1014), as shown in FIG. 10A. Although the channels, recesses, and side wall described above by reference to FIG. 10D are not described by reference to each of the figures provided herein, such elements are illustrated and contemplated in the various exemplary embodiments described below.

In the exemplary embodiment, circuit interrupter 1006 is positioned between terminals 1008 and 1010 as well as between conductors 1002 and 1004. This provides the advantage of a compact design having a profile of an industry standard plug. Housing body 1016 includes pins 1017 which mate with holes 1019 formed in cover 1018 (best shown in FIG. 10C). It is contemplated that pins 1017 may snap fit into holes 1019, for example. It is also contemplated that pins 1017 may be attached to cover 1018 via holes 1019 using various means, such as thermally welding pins 1017 to cover 1018, for example. After assembly of housing 1016 and housing cover 1018 (with their internal components) the assembly is completed by applying cover 1020, such as by molding.

Figure 11A:
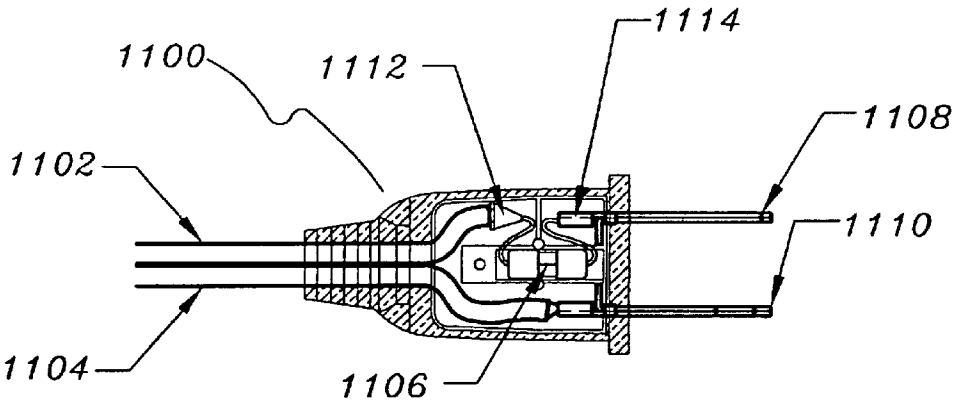
FIG. 11A is a top interior view of a cord set plug assembly in accordance with a third exemplary embodiment of the present invention.
Figure 11B:
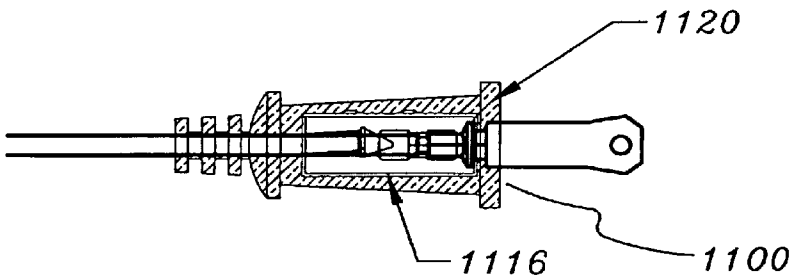
FIG. 11C is a top view of a housing of the cord set plug assembly of FIG. 11A.
FIG. 11D is a side view of a housing of the cord set plug assembly of FIG. 11A.
Figure 11C:
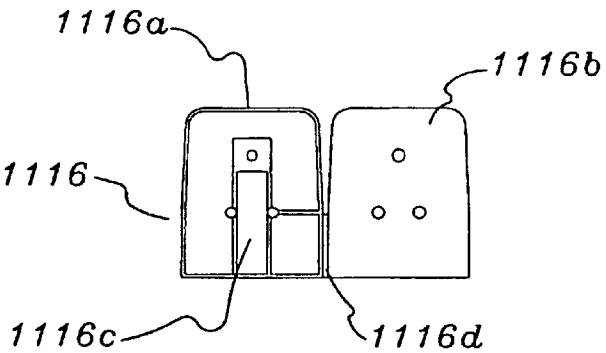
Figure 11D:
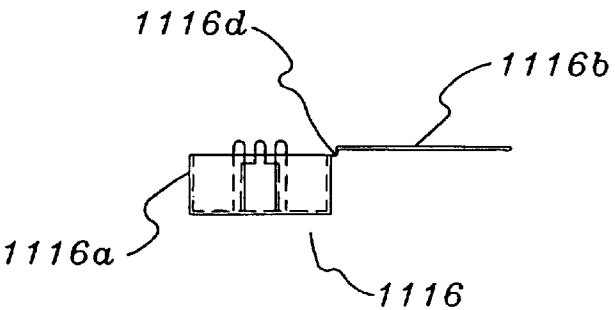

FIGS. 11A–11D illustrate various views of safety device 1100 and its various components according to an exemplary embodiment of the present invention. In certain respects safety device 1100 is very similar to safety device 1000 described above by reference to FIGS. 10A-10D. As shown in FIG. 11A, safety device 1100 includes conductor 1102 electrically connected to terminal 1108 through connector 1112, circuit interrupter 1106, and connector 1114. Conductor 1104 is electrically connected to terminal 1110. FIG. 11B illustrates housing 1116 and cover 1120 (e.g., over mold cover 1120). As shown in FIG. 11C, housing 1116 includes lower portion 1116*a* that is integrally hinged with housing cover 1116*b* through hinge 1116*d*. Lower portion 1116*a* defines cavity 1116*c* for housing circuit interrupter 1106. FIG. 11D is a side view of housing 1116 including lower portion 1116*a* and housing cover 1116*b*. In all other respects this embodiment is similar to the embodiment referred to in FIGS. 10A–10D.

FIGS. 12A–12D illustrate various views of safety device 1200 and its various components according to an exemplary embodiment of the present invention. As shown in FIG.

Figure 12A:
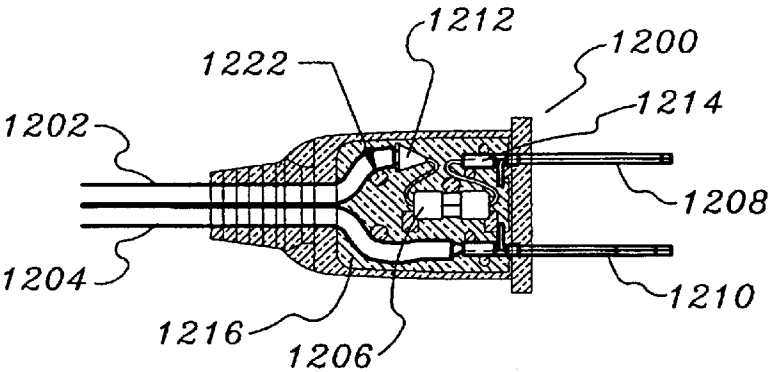
FIG. 12A is a top interior view of a cord set plug assembly in accordance with a fourth exemplary embodiment of the present invention.
Figure 12B:
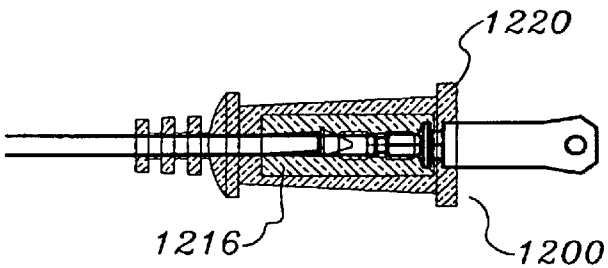
FIG. 12B is a side interior view of the cord set plug assembly of FIG. 12A.
Figure 12C:
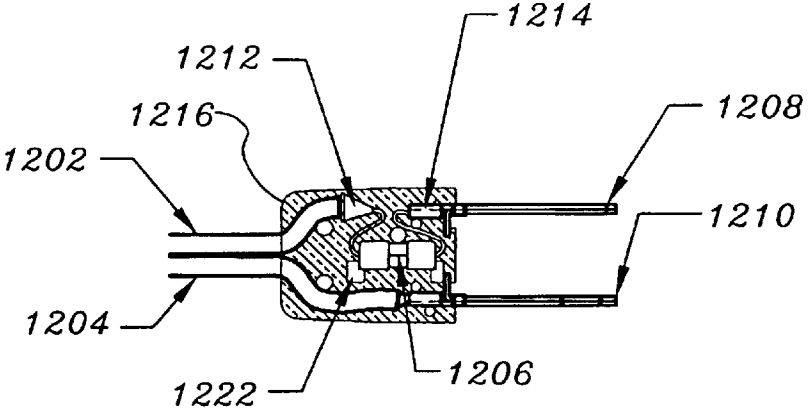
FIG. 12C is a top interior view of a portion of the cord set plug assembly of FIG. 12A.
Figure 12D:
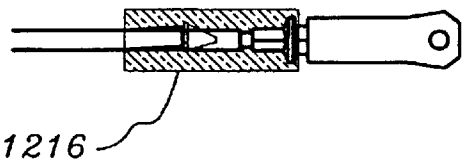
FIG. 12D is a side interior view of a portion of the cord set plug assembly of FIG. 12A.

12A, safety device 1200 includes conductors 1202 and 1204. Conductor 1204 is electrically connected to terminal 1210. Connector 1202 is electrically connected to terminal 1208 through connector 1212, circuit interrupter 1206, and connector 1214. As shown in FIG. 12B, safety device 1200 includes housing 1216 (for housing various components including connector 1212, circuit interrupter 1206, and connector 1214) and cover 1220. In this exemplary embodiment, housing 1216 is mold encapsulated with an insulative material (as shown by the hatch markings in FIGS. 12A–12D). That is, the various internal components (1202, 1204, 1206, 1208, 1210, 1212, 1214, etc.) are placed in a mold (not shown) and positioned by positioning elements (not shown), such as pins. A molding material is injected into the mold to encapsulate the internal components. When housing 1216 is removed from the mold alignment voids 1222 remain. FIGS. 12C and 12D are interior top and side views of mold encapsulated housing 1216. In the exemplary embodiment of the present invention illustrated in FIGS. 12A–12D, circuit interrupter 1206 (and other internal components) is aligned within safety device 1200 as discussed above by the alignment elements resulting in voids 1222. After molding of housing 1216 the assembly is completed by applying cover 1220, which may or may not be used to fill voids 1222.

Figure 13A:
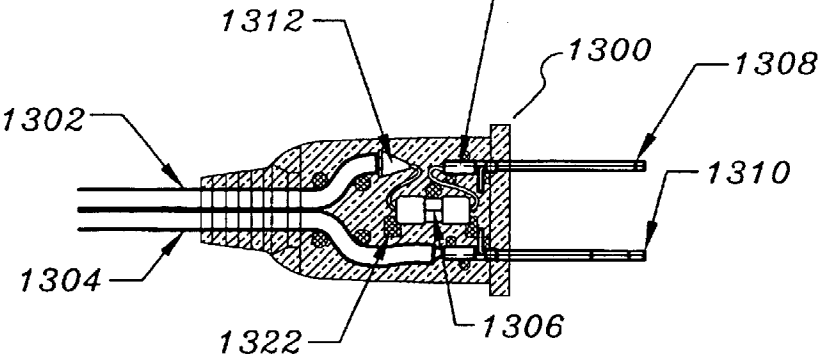
FIG. 13A is a top interior view of a cord set plug assembly in accordance with a fifth exemplary embodiment of the present invention.
Figure 13B:
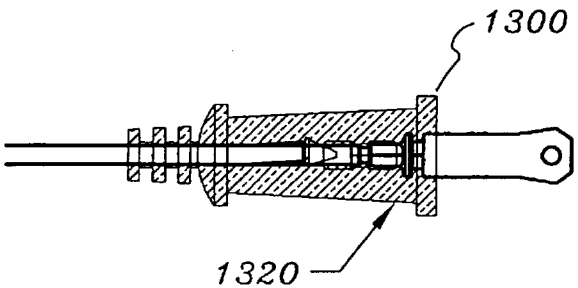
FIG. 13B is a side interior view of the cord set plug assembly of FIG. 13A.

FIGS. 13A and 13B are interior top and side views of safety device 1300 according to an exemplary embodiment of the present invention. As illustrated in FIG. 13A, safety device 1300 includes conductors 1302 and 1304, electrically connected respectively to terminals 1308 and 1310. Conductor 1302 is electrically connected to terminal 1308 through connector 1312, circuit interrupter 1306, and connector 1314. In this exemplary embodiment the cover and housing of the exemplary embodiment of FIGS. 12A–12D are combined in a single mold operation. In all other respects this embodiment is similar to the embodiment referred to in FIGS. 12A–12D, except that voids 1322 (alignment cavities) may be filled with an insulative epoxy in the embodiment illustrated in FIG. 13A.

FIGS. 14A–14E illustrate various views of safety device 1400 and its various components according to an exemplary embodiment of the present invention. As illustrated in FIG. 14A, conductor 1402 is electrically connected to terminal 1408 through connector 1412, circuit interrupter 1406, and connector 1414. Conductor 1404 is electrically connected to terminal 1410. FIG. 14B is an internal side view of safety device 1400. Safety device 1400 includes cover 1424, including lower portion 1424*a* and upper portion 1424*b* mated at mating surface 1426. In order that the interior of safety device 1400 be substantially inaccessible after manufacture, mating surface 1426 is closed using, for example, an adhesive, a sonic weld, a chemical reaction, etc. Alternatively, a fastener (not illustrated) may be used to close mating surface 1426 such that the interior of safety device 1400 is substantially inaccessible. FIG. 14C is an internal front view of safety device 1400 including lower portion 1424*a*, upper portion 1424*b* and circuit interrupter 1406. FIG. 14D is a top view of cover 1424 illustrating hinge 1424*c* that hingedly connects upper portion 1424*b* with lower portion 1424*a*. Lower portion 1424*a* includes cavity 1424*d* for housing circuit interrupter 1406. FIG. 14E is a front view of cover 1424 with upper portion 1424*b* in an open position with respect to lower portion 1424*a*.

Figure 15A:
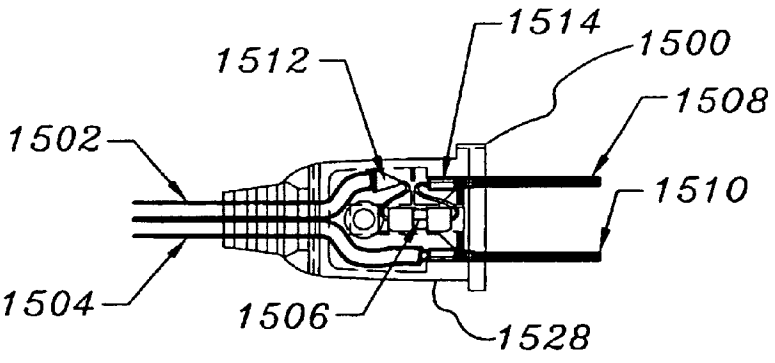
FIG. 15A is a top interior view of a cord set plug assembly in accordance with a seventh exemplary embodiment of the present invention.
Figure 15C:
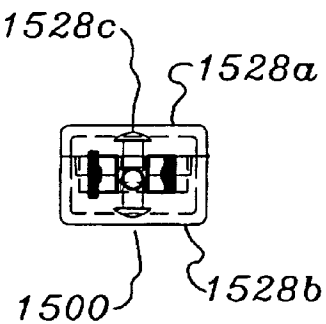
FIG. 15C is a front interior view of the cord set plug assembly of FIG. 15A.
Figure 15B:
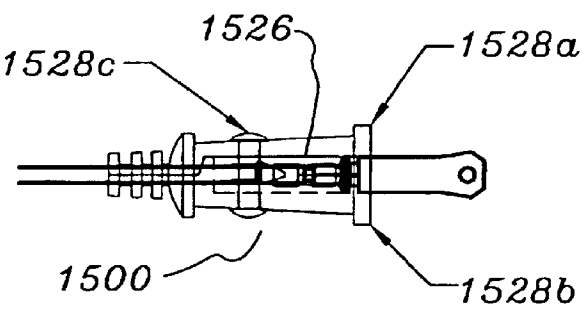
FIG. 15B is a side interior view of the cord set plug assembly of FIG. 15A.
Figure 15D:
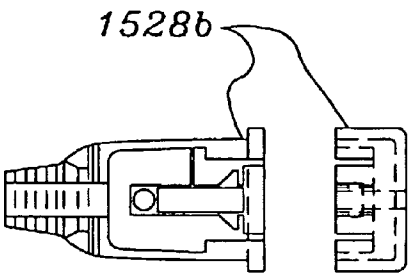
FIG. 15D is a top view and a side view of a portion of the cord set plug assembly of FIG. 15A.
Figure 15E:
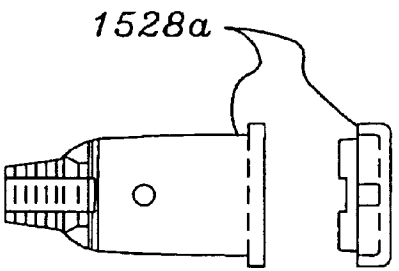
FIG. 15E is a top view and a side view of a portion of the cord set plug assembly of FIG. 15A.

FIGS. 15A–15E illustrate various views of safety device 1500 and its associated components according to an exemplary embodiment of the present invention. The primary difference between safety device 1500 and safety device 1400 (described by reference to FIGS. 14A–14E) is that cover 1528 includes a separated upper portion 1528*a* and lower portion 1528*b* (in contrast to hingedly connected upper portion 1424*b* and lower portion 1424*a*). As illustrated in FIG. 15A, conductor 1502 is electrically connected to terminal 1508 through connector 1512, circuit interrupter 1506, and connector 1514. Conductor 1504 is electrically connected to terminal 1510. As shown in FIG. 15B, upper portion 1528*a* is mated with lower portion 1528*b* at mating surface 1526 using fastener 1528*c* (e.g., rivet, screw, bolt, snap, etc.). Alternatively, upper portion 1528*a* may be mated with lower portion 1528*b* at mating surface 1526 using, for example, an adhesive, a sonic weld, a chemical reaction, etc. FIG. 15C is a front view of safety device 1500 including upper portion 1528*a*, lower portion 1528*b* and fastener 1528*c*. FIG. 15D includes a top view and a end view of lower portion 1528*b*. Lower portion 1528*b* defines cavity 1528*d* for housing circuit interrupter 1506. FIG. 15E is a top view and a end view of upper portion 1528*a*.

Figure 16A:
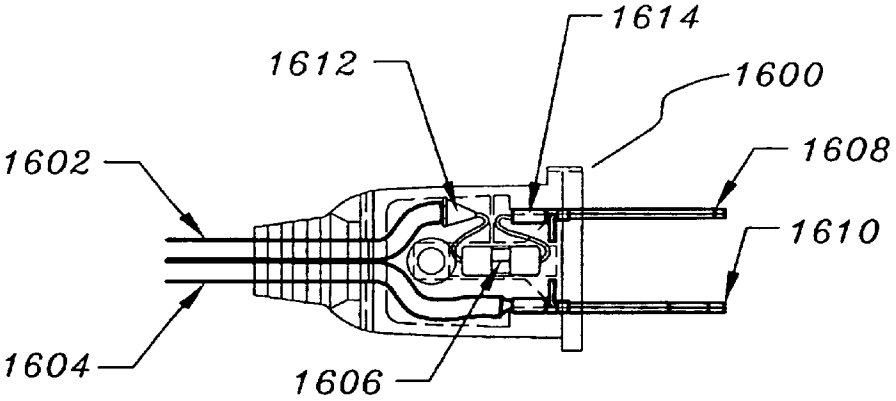
FIG. 16A is a top interior view of a cord set plug assembly in accordance with an eighth exemplary embodiment of the present invention.
Figure 16B:
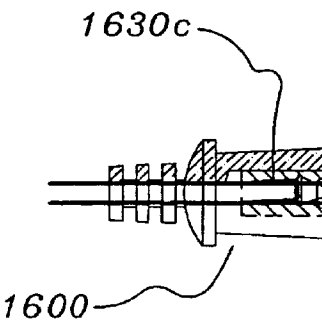
FIG. 16B is a side interior view of the cord set plug assembly of FIG. 16A.
Figure 16C:
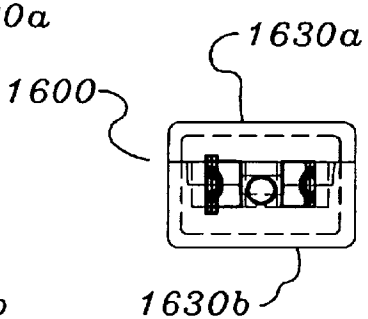
FIG. 16C is a front interior view of the cord set plug assembly of FIG. 16A.
Figure 16D:
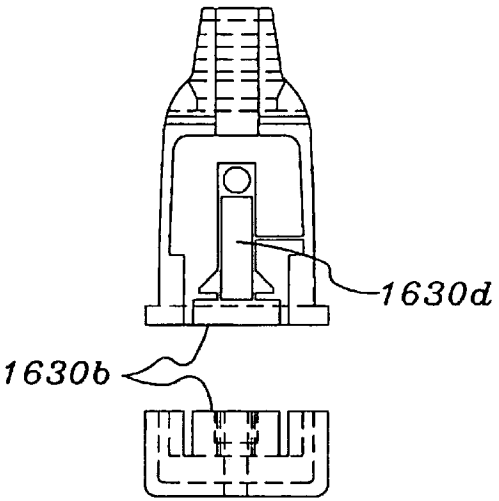
FIG. 16D is a top view and a side view of a portion of the cord set plug assembly of FIG. 16A.

FIGS. 16A–16D illustrate various views of safety device 1600 and its associated components according to an exemplary embodiment of the present invention. As shown in FIG. 16A, conductor 1602 is electrically connected to terminal 1608 through connector 1612, circuit interrupter 1606, and connector 1614. Conductor 1604 is electrically connected to terminal 1610. FIG. 16B is an internal side view of safety device 1600 having a housing including lower portion 1630*b* and upper portion 1630*a*. As shown in FIG. 16B, upper portion 1630*a*, as well as an internal portion of safety device 1600 (including connector 1612, circuit interrupter 1606, and connector 1614) is partially over molded. By over molding these portions of safety device 1600, the internal elements of the safety device are held in place, and a secure upper portion 1630*a* is provided. FIG. 16C is a front view of safety device 1600 including upper portion 1630*a* and lower portion 1630*b*. FIG. 16D includes a top view and a end view of lower portion 1630*b*. Lower portion 1630*b* defines cavity 1630*d* for housing circuit interrupter 1606.

Figure 17A:
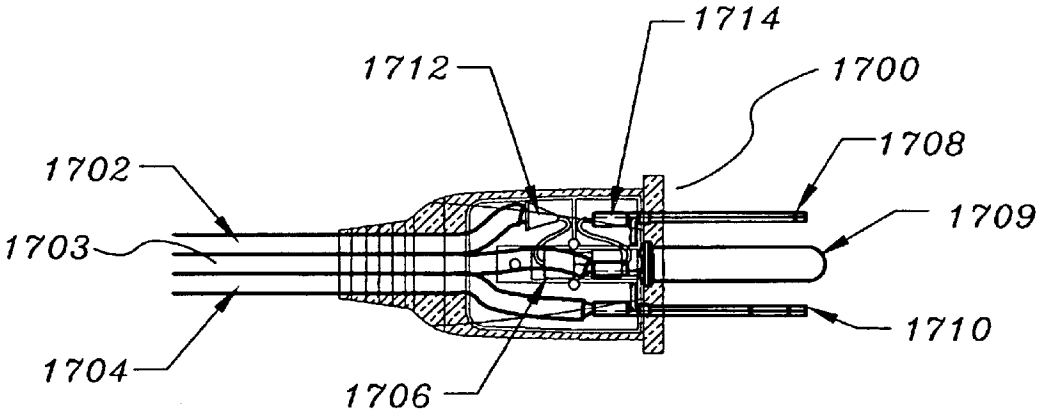
FIG. 17A is a top interior view of a cord set plug assembly in accordance with a ninth exemplary embodiment of the present invention.
Figure 17B:
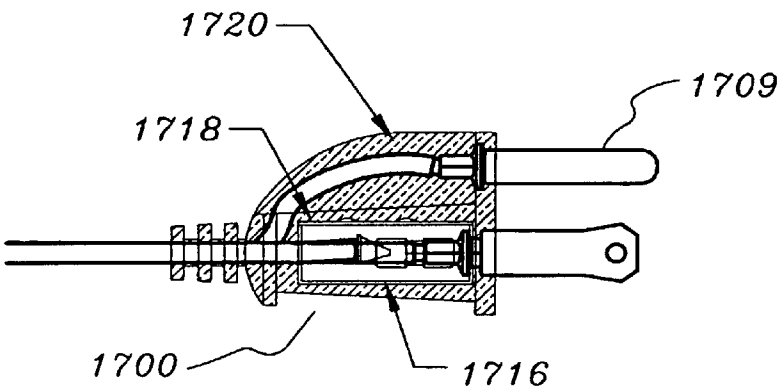
FIG. 17B is a side interior view of the cord set plug assembly of FIG. 17A.
Figure 17C:
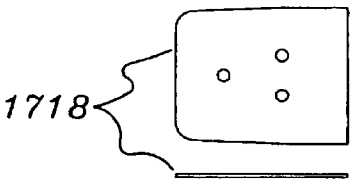
FIG. 17C is a top view and a side view of a housing cover of the cord set plug assembly of FIG. 17A.
Figure 17D:
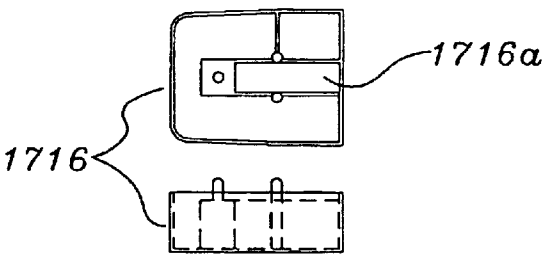
FIG. 17D is a top view and a side view of a housing body of the cord set plug assembly of FIG. 17A.

FIGS. 17A–17D illustrate various views of safety device 1700 and its associated components according to an exemplary embodiment of the present invention. Safety device 1700 is a three pronged device including terminals 1708, 1709, and 1710. Terminal 1709 is included to provide additional grounding protection for the electrical device/apparatus (e.g., an electrical fan) to which safety device 1700 is attached. As illustrated in FIG. 17A, conductor 1702 is electrically connected to terminal 1708 through connector 1712, circuit interrupter 1706, and connector 1714. Conductor 1703 is electrically connected to terminal 1709, and conductor 1704 is electrically connected to terminal 1710. FIG. 17B is an internal side view of safety device 1700, including housing body 1716, housing cover 1718, and cover 1720. FIG. 17C illustrates a top view and a side view of housing cover 1718. FIG. 17D illustrates a top view and a side view of housing body 1716. Housing body 1716 defines cavity 1716*a* for housing circuit interrupter 1706.

Figure 18A:
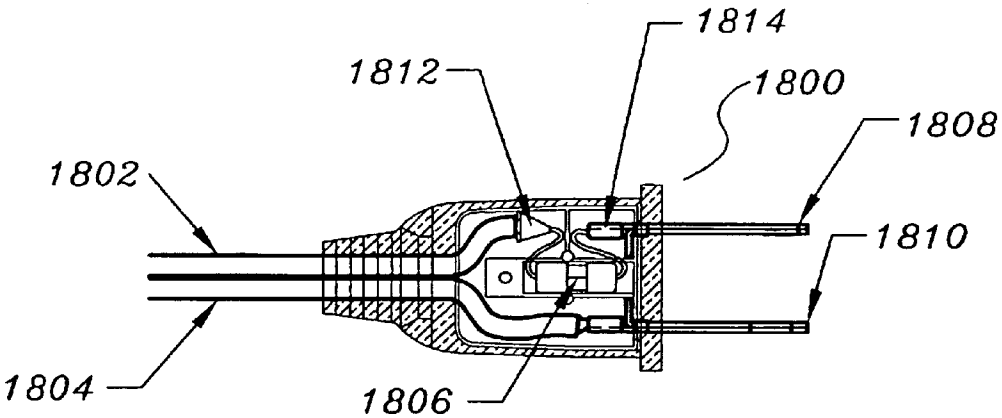
FIG. 18A is a top interior view of a cord set plug assembly in accordance with a tenth exemplary embodiment of the present invention.
Figure 18B:
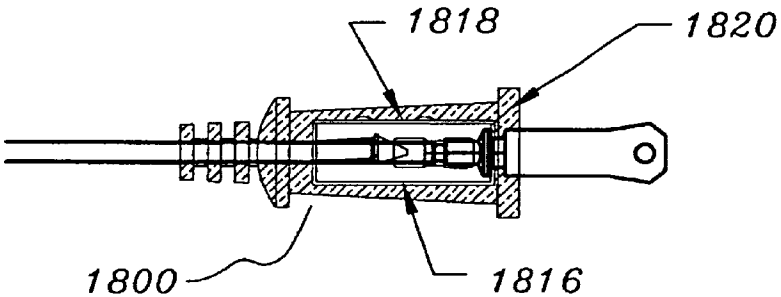
FIG. 18B is a side interior view of the cord set plug assembly of FIG. 18A.
Figure 18C:
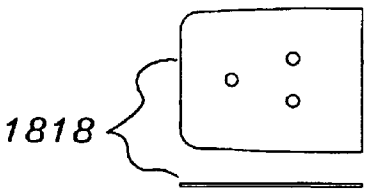
FIG. 18C is a top view and a side view of a housing cover of the cord set plug assembly of FIG. 18A.
Figure 18D:
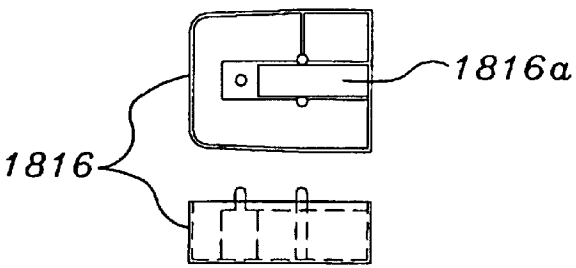
FIG. 18D is a top view and a side view of a housing body of the cord set plug assembly of FIG. 18A.

FIGS. 18A–18D illustrate various views of safety device 1800 and its associated components according to an exemplary embodiment of the present invention. As shown in FIG. 18A, conductor 1802 is electrically connected to terminal 1808 through connector 1812, circuit interrupter 1806, and connector 1814. Conductor 1804 is electrically connected to terminal 1810. FIG. 18B is an internal side view of safety device 1800 including housing body 1816, housing cover 1818, and cover 1820. FIG. 18C illustrates a top view and a side view of housing cover 1818. FIG. 18D illustrates a top view and a side view of housing body 1816. Housing body 1816 defines cavity 1816*a* for housing circuit interrupter 1806.

In the exemplary embodiment of the present invention illustrated in FIGS. 18A–18D, at least a portion of cover 1820 (e.g., over mold cover) is constructed from a transparent or translucent material. Further, at least a portion of housing body 1816 and/or housing cover 1818 is also constructed from a transparent or translucent material. As such, the status of circuit interrupter 1806 (e.g., fuse 1806) may be determined by looking through these transparent/translucent materials. For example, in an embodiment where circuit interrupter 1806 is a fuse, an open (i.e., blown) or closed (i.e., contacted) fuse status may be determined.

Figure 19A:
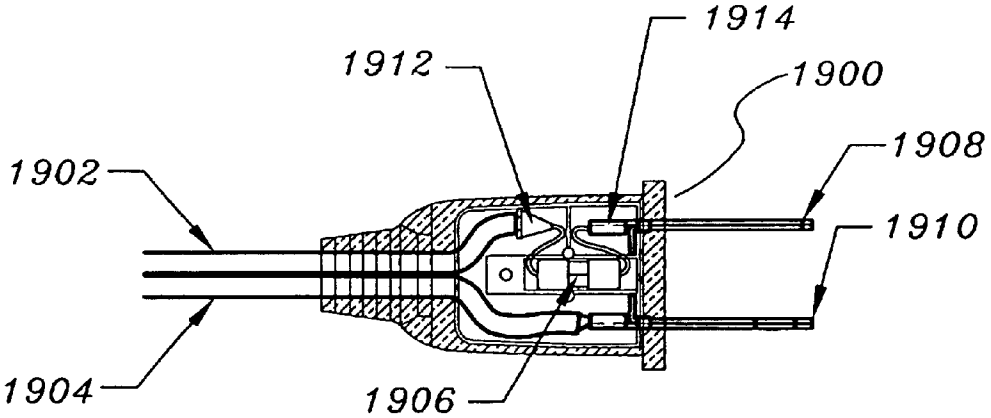
FIG. 19A is a top interior view of a cord set plug assembly in accordance with an eleventh exemplary embodiment of the present invention.
Figure 19B:
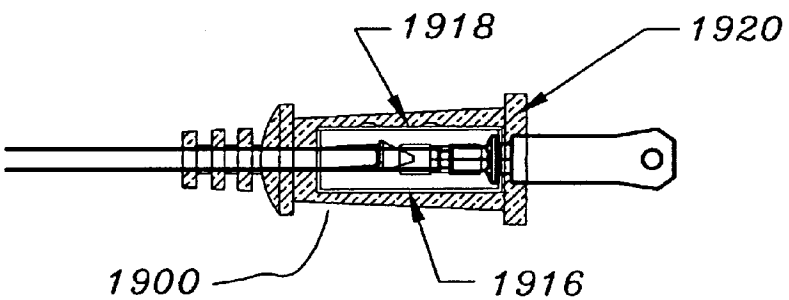
FIG. 19B is a side interior view of the cord set plug assembly of FIG. 19A.
Figure 19C:
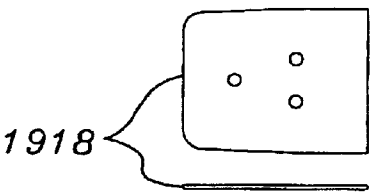
FIG. 19C is a top view and a side view of a housing cover of the cord set plug assembly of FIG. 19A.
Figure 19D:
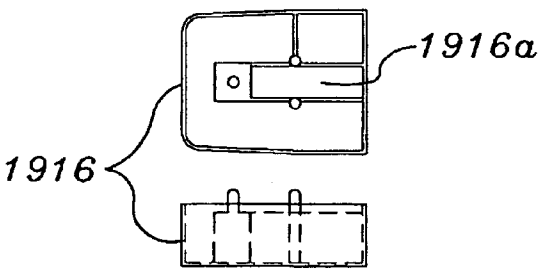
FIG. 19D is a top view and a side view of a housing body of the cord set plug assembly of FIG. 19A.

FIGS. 19A–19B illustrate various views of safety device 1900 and its associated components according to an exemplary embodiment of the present invention. As illustrated in FIG. 19A, conductor 1902 is electrically connected to terminal 1908 through connector 1912, circuit interrupter 1906, and connector 1914. Conductor 1904 is electrically connected to terminal 1910. FIG. 19B is an internal side view of safety device 1900 including housing body 1916, housing cover 1918, and cover 1920. FIG. 19C illustrates a top view and a side view of housing cover 1918. FIG. 19D illustrates a top view and a side view of housing body 1916. Housing body 1916 defines cavity 1916*a* for housing circuit interrupter 1906.

In the exemplary embodiment of the present invention illustrated in FIGS. 19A–19D, at least one of housing body 1916 and housing cover 1918 is at least partially constructed from a thermally reactive material (e.g., a thermally reactive polymer material). For example, housing body 1916 (or a portion of housing body 1916) may be constructed from a thermally reactive material that changes its appearance (e.g., color) upon experiencing a predetermined change in temperature (e.g., a rise in temperature). For example, this predetermined change in temperature may be experienced from a blown fuse (in an embodiment where the circuit interrupter is a fuse). Alternatively, housing cover 1918 may be at least partially constructed from such a thermally reactive material. Additionally, at least a portion of cover 1920 (e.g., over mold cover 1920) is constructed from a transparent or a translucent material. If only a portion of cover 1920 is constructed of the transparent/translucent material, this transparent/translucent portion should be positioned adjacent to a thermally reactive portion of at least one of housing body 1916 or housing cover 1918.

As such, when circuit interrupter 1906 activates (e.g., the fuse blows) due to excessive current, at least a portion of housing body 1916 and/or housing cover 1918 will change in appearance. For example, this change in appearance of housing body 1916 and/or housing cover 1918 may be a change in color. Because at least a portion of cover 1920 is transparent/translucent, the change in appearance of housing body 1916 and/or housing cover 1918 may be viewed by a user of safety device 1900.

Figure 20A:
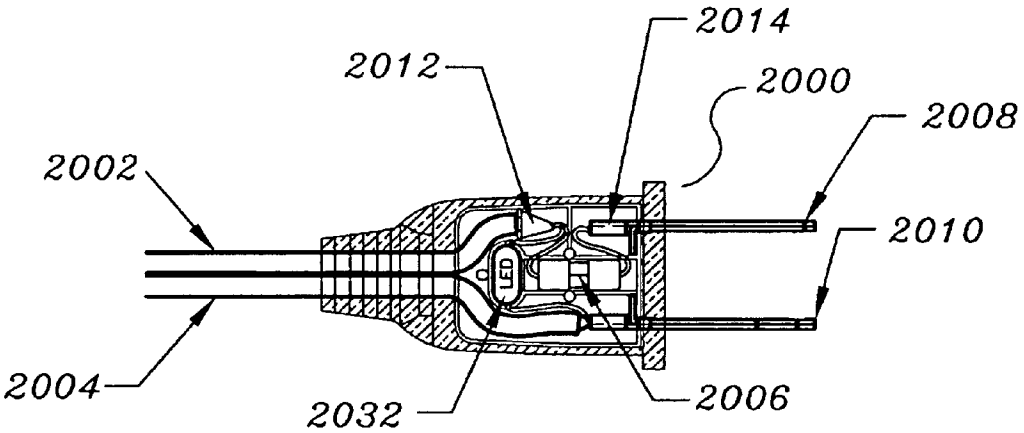
FIG. 20A is a top interior view of a cord set plug assembly in accordance with a twelfth exemplary embodiment of the present invention.
Figure 20B:
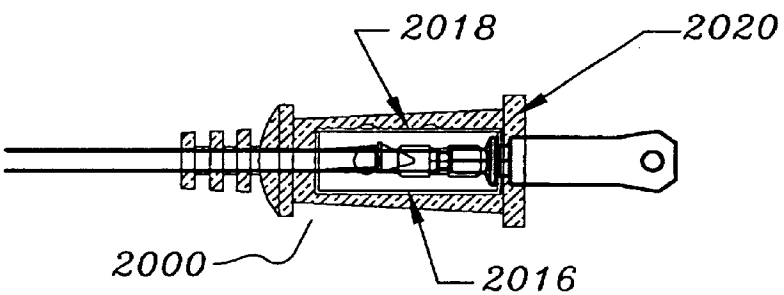
FIG. 20B is a side interior view of the cord set plug assembly of FIG. 20A.
Figure 20C:
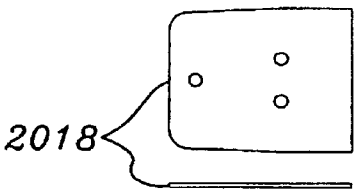
FIG. 20C is a top view and a side view of a housing cover of the cord set plug assembly of FIG. 20A.
Figure 20D:
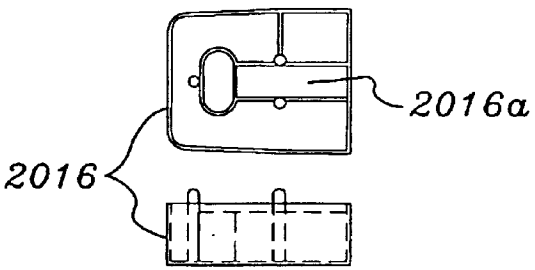
FIG. 20D is a top view and a side view of a housing body of the cord set plug assembly of FIG. 20A.

FIGS. 20A–20D illustrate various views of safety device 2000 and its associated components according to an exemplary embodiment of the present invention. As illustrated in FIG. 20A, conductor 2002 is electrically connected to terminal 2008 through connector 2012, circuit interrupter 2006, and connector 2014. Conductor 2004 is electrically connected to terminal 2010. Safety device 2000 also includes an indicator 2032 (such as an LED device) electrically connected to at least one of conductors 2002 and 2004 such that indicator 2032 provides a visual identity of the status of circuit interrupter 2006 (e.g., blown or not blown if circuit interrupter 2006 is a fuse). For example, indicator 2032 may glow/illuminate if contact is maintained (i.e., the fuse is intact). FIG. 20B is an internal side view of safety device 2000 including housing body 2016, housing cover 2018, and cover 2020. FIG. 20C illustrates a top view and a side view of housing cover 2018. FIG. 20D illustrates a top view and a side view of housing body 2016. Housing body 2016 defines cavity 2016*a* for housing circuit interrupter 2006.

In the exemplary embodiment of the present invention illustrated in FIGS. 20A–20D, at least a portion of cover 2020 is constructed of a transparent or translucent material. Further, at least a portion of housing body 2016 and/or housing cover 2018 is also constructed of a transparent/translucent material; As such, the illumination status of indicator 2032 (that corresponds to the status of circuit interrupter 2006) may be viewed by a user of safety device 2000. Unless an internal power source is included in safety device 2000 to provide illumination to indicator 2032, safety device 2000 must be engaged with an electrical receptacle in order for this feature to function properly. As opposed to utilizing a transparent/translucent material, other methods of providing the illumination status of indicator 2032 are contemplated. For example, a portion indicator 2032 may protrude from (or be sufficiently close to) a surface of housing 2016/2018 and cover 2020 to allow the status of indicator 2032 to be viewed by a user of the safety device without using transparent/translucent materials.

Figure 21A:
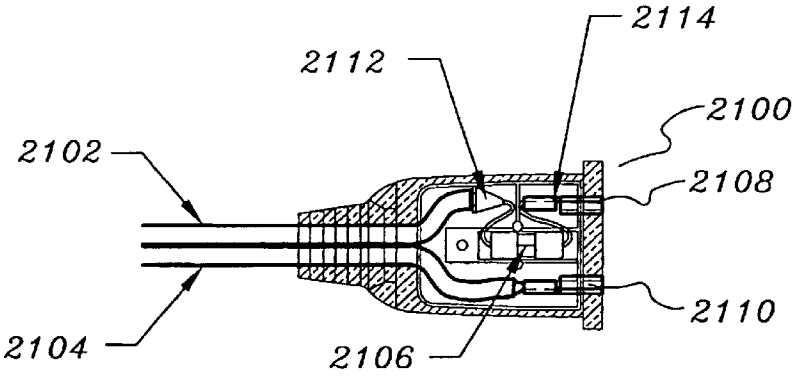
FIG. 21A is a top interior view of a cord set plug assembly in accordance with a thirteenth exemplary embodiment of the present invention.
Figure 21B:
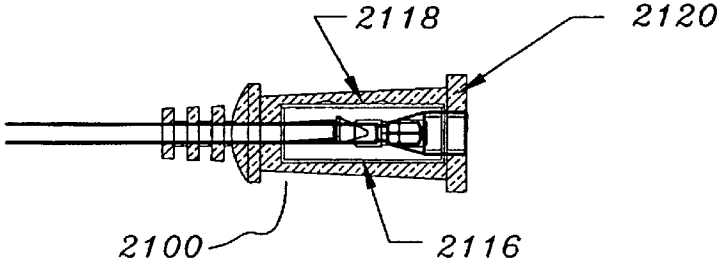
FIG. 21B is a side interior view of the cord set plug assembly of FIG. 21A.

FIG. 21A provides an interior view of safety device 2100 (e.g., fused cord set plug assembly 2100) according to an exemplary embodiment of the present invention. Safety device 2100 includes conductors 2102 and 2104 that are electrically connected to terminals 2108 and 2110. Conductor 2102 is electrically connected to terminal 2108 through connection 2112, circuit interrupter 2106, and connector 2114. Connectors 2112 and 2114, for example, may be crimp connections. FIG. 21B is a side view of safety device 2100. As shown in FIG. 21B, safety device 2100 includes housing body 2116, housing cover 2118, and cover 2120 (e.g., over mold cover 2120). Connector 2112, circuit interrupter 1006, and connector 2114 are housed within housing body 2116 and housing cover 2118.

In the exemplary embodiment of the present invention illustrated in FIGS. 21A–21B, terminals 2108 and 2110 are female terminal connectors. As such, safety device 2100 (including housing body 2116 and housing cover 2118) may be viewed as an electrical receptacle that may be connected directly to an electrical apparatus. This is in contrast to the male terminal connectors illustrated in various alternative embodiments of the present invention. Regardless of the type of terminal (i.e., male or female) illustrated in each of exemplary embodiments of the present invention, each of these embodiments and their equivalents may be provided with either of a male and a female terminal.

Figure 22A:
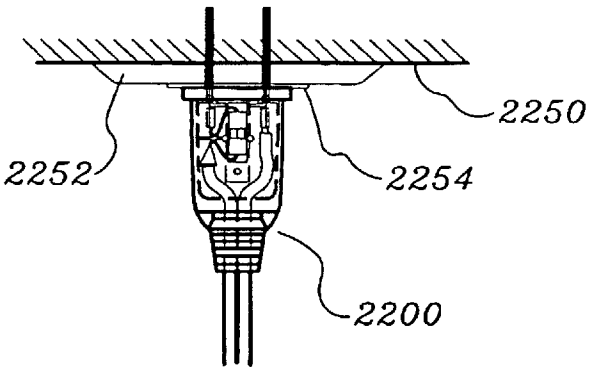
FIG. 22A is a top interior view of a cord set plug assembly engaged with an electrical receptacle in accordance with an exemplary embodiment of the present invention.
Figure 22B:
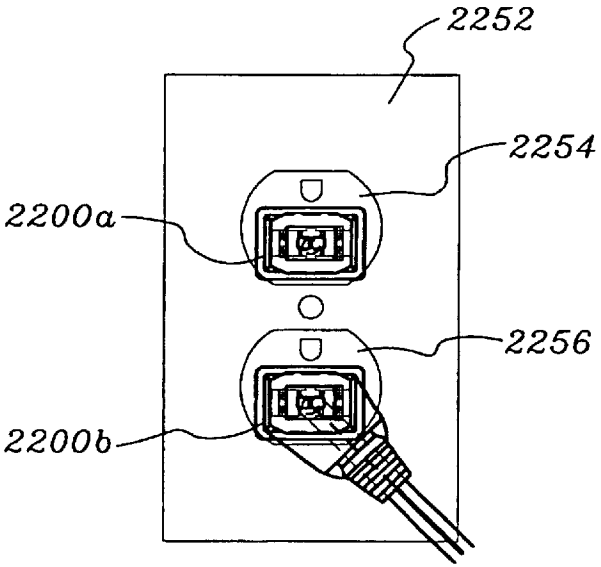
FIG. 22B is a front interior view of two cord set plug assemblies engaged with electrical receptacles in accordance with an exemplary embodiment of the present invention.
Figure 22C:
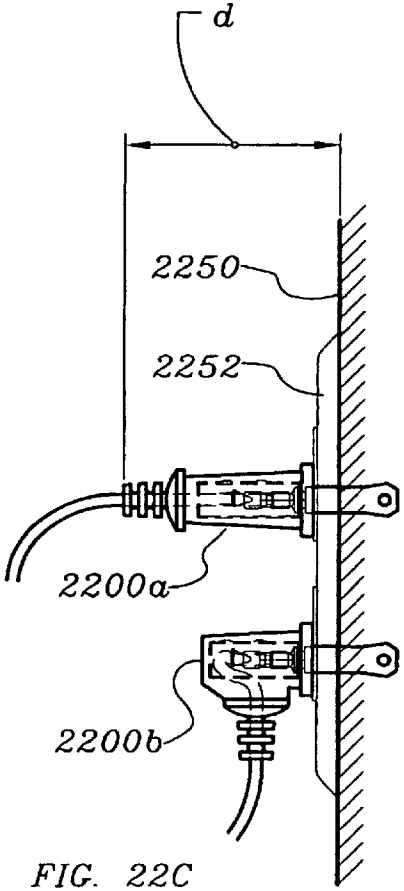
FIG. 22C is a side interior view of FIG. 22B.

FIG. 22A is an internal top view of safety device 2200. Safety device 2200 is engaged with an electrical receptacle 2254. Electrical receptacle 2254 is positioned substantially within wall 2250, and partially covered with cover 2252. FIG. 22B is a front view of cover 2252, electrical receptacle 2254, and electrical receptacle 2256. Safety device 2200*a* is engaged with receptacle 2254, and safety device 2200*b* is engaged in an offset configuration with electrical receptacle 2256. As shown in FIG. 22B, safety device 2200*a* extends substantially orthogonal with respect to a surface of receptacle 2254. FIG. 22C is an internal side view of safety device 2200*a* and safety device 2200*b*. The distance "d" between wall 2250 and an opposite end of safety device 2200*a* may be designed to be a standard plug distance such that safety device 2200*a* does not interfere with furniture and other objects positioned adjacent to wall 2250. Safety devices 2200*a* and 2200*b* may be designed to have a polarized plug design such that inverted insertion into an electrical receptacle is not possible.

As illustrated in FIGS. 22A–22C, safety device 2200 (or devices 2200*a* and 2200*b*) is sized such that both electrical receptacles (e.g., 2254 and 2256) may be used. A single safety device 2200 does not block two receptacles.

Figure 23B:
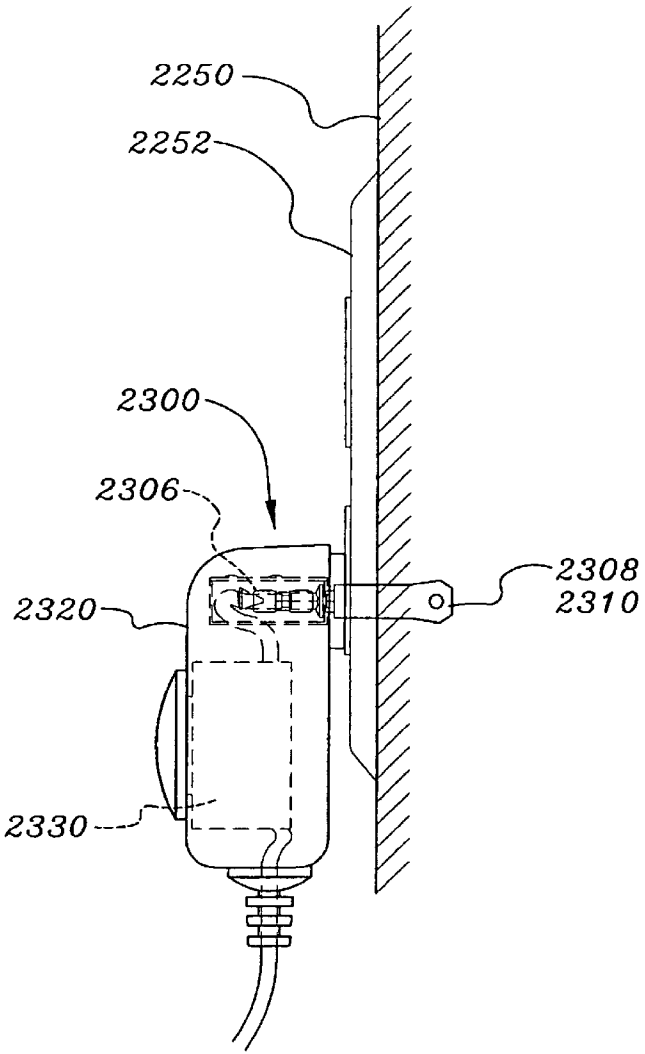
FIGS. 23A and 23B illustrate another exemplary embodiment of the present invention used in conjunction with other components within the housing.
Figure 23A:
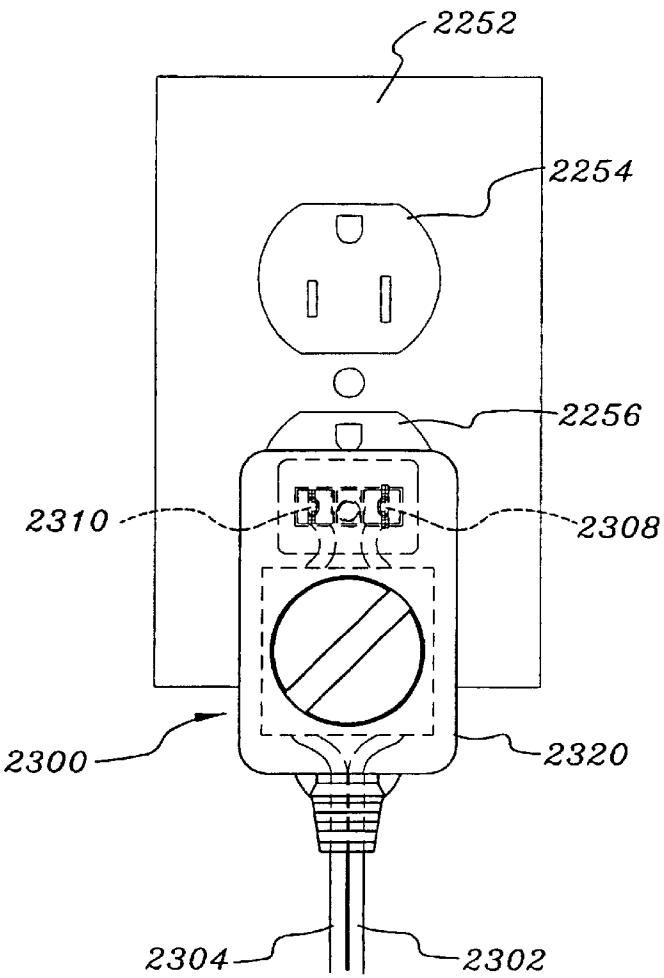

FIGS. 23A and 23B illustrate an exemplary embodiment of safety device 2300 in which one or more control components 2330 might be added within housing 2320. FIGS. 23A and 23B show a non-replaceable circuit interrupter 2306 connected to at least one of terminals 2308 and 2310. Also included within the structure of housing 2320 are one or more control components 2330. Control components 2330 may include but are not limited to one or more of: on-off switches, timers, transformers, active and/or passive electrical circuitry, various types of circuit protection, etc.

The placement of non-replaceable circuit interrupter 2306 within housing 2320 that also includes control components 2330 creates additional safety for the entire system, as discussed above with respect to the embodiments illustrated in FIGS. 1–22C. This added safety created by circuit interrupter 2306 may thus also encompass control components 2330 located within housing 2320. In one exemplary embodiment, control component 2330 is coupled between non-replaceable circuit interrupter 2306 and terminal 2308 (and/or 2310). In an alternate embodiment, control component 2330 is coupled between non-replaceable circuit interrupter 2306 and conductor 2302 (and/or 2304).

As shown in FIGS. 23A and 23B the structure and dimensions of housing 2320 are adapted to accommodate the space requirements of additional control components 2330 and therefore may not be limited to the size of a standard electrical plugs, as discussed with reference to the exemplary embodiment illustrated in FIGS. 22A, 22B and 22C.

Figure 24:
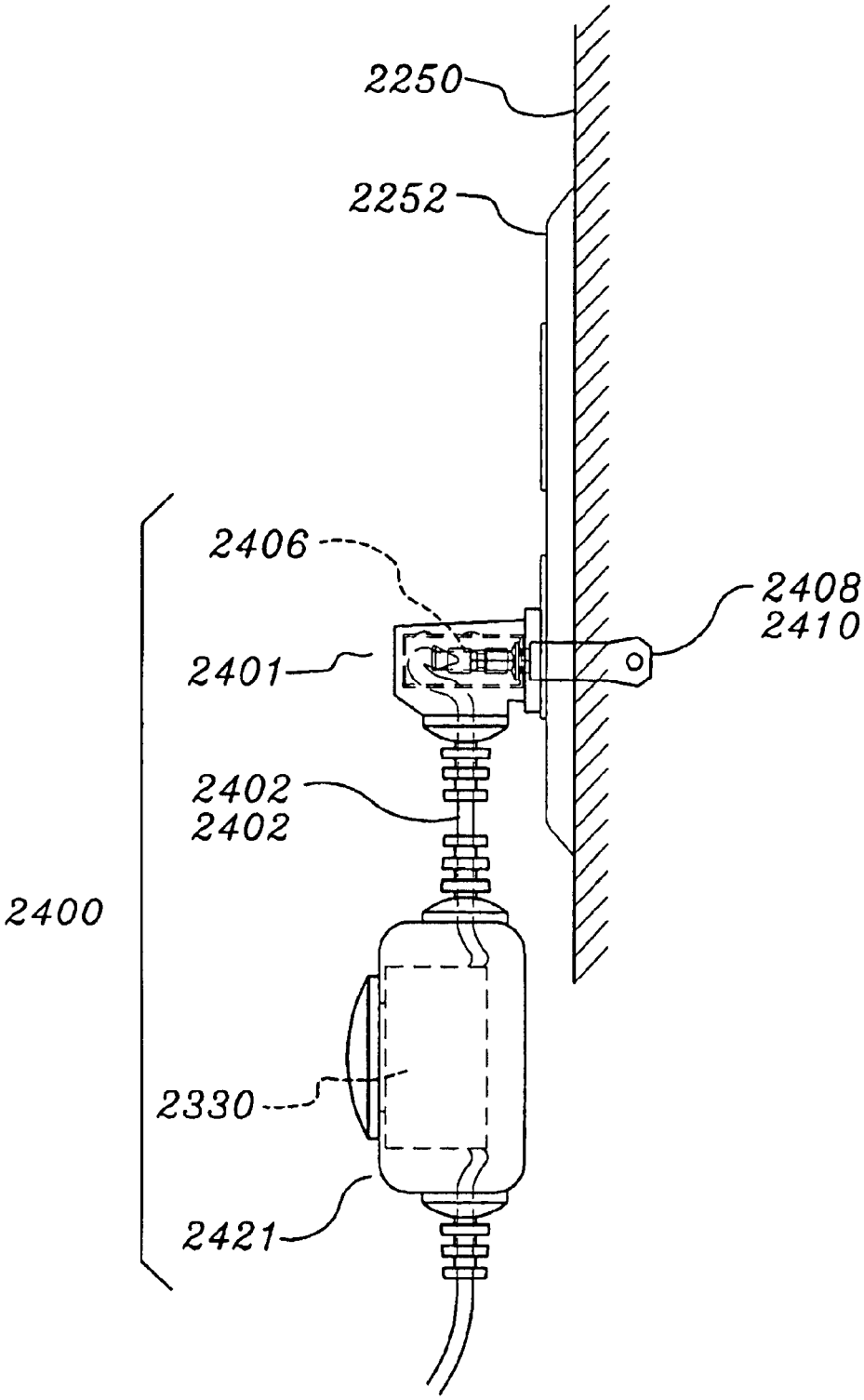
FIG. 24 illustrates still another exemplary embodiment of the present invention used in conjunction with other components within an additional housing.

FIG. 24 illustrates an exemplary embodiment of safety device 2400 in which one or more control components 2330 might be added. Safety device 2400 is similar to the embodiment described in FIGS. 23A and 23B, however, non-replaceable circuit interrupter 2406 along with terminals 2408, 2410 are in first housing 2401, and additional control components 2330 are in second housing 2421. Conductors 2402 and 2404 exit first housing 2401 and enter second housing 2421. Preferably, second housing 2421 is located proximate first housing 2401 in order to add safety to substantially all of the cord set. First housing 2401 may be constructed from components similar to those described above with respect to the embodiment illustrated in FIGS. 1–22C including non-replaceable circuit interrupter 2406.

Figure 25:
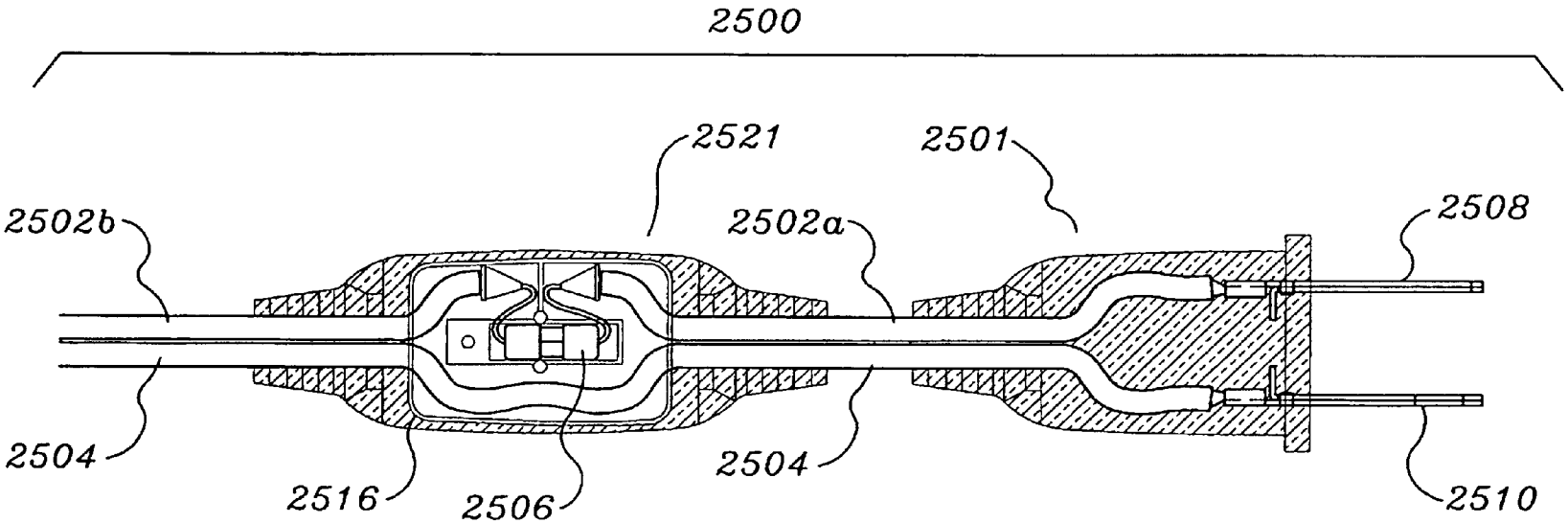
FIG. 25 illustrates yet another exemplary embodiment of the present invention.

FIG. 25 illustrates an exemplary embodiment of safety device 2500. Safety device 2500 is similar to other embodiments described in FIGS. 1–22C, however, the plug and non-replaceable circuit interrupter are in separate housings. As shown, safety device 2500 is comprised of a conventional type plug 2501 having at least two terminals 2508 and 2510 connected to conductors 2502*a* and 2504. Conductors 2502*a* and 2504 exit conventional type plug 2501 and enter housing 2521. Conductors 2502*a* is coupled to one end of non-replaceable circuit interrupter 2506, with the second end coupled to conductors 2502*b*. Conductors 2502*b* and 2504 then exit housing 2521 and are ultimately connected to other down stream components or devices (not shown). Preferably, housing 2521 is located proximate conventional type plug 2501 in order to add safety to substantially all of the cord set. Housing 2521 and housing body 2516 may be constructed from components similar to those described above with respect to the embodiments illustrated in FIGS. 1–22C including non-replaceable circuit interrupter 2506.

Although housing 2521 is shown to be the approximate the size of standard plug 2501, the invention is not so limited. It is contemplated that the size housing 2521 may vary in size including becoming an integral part of one of conductor 2502 and 2504 (best shown in FIGS. 27A and 27B)

Figure 26:
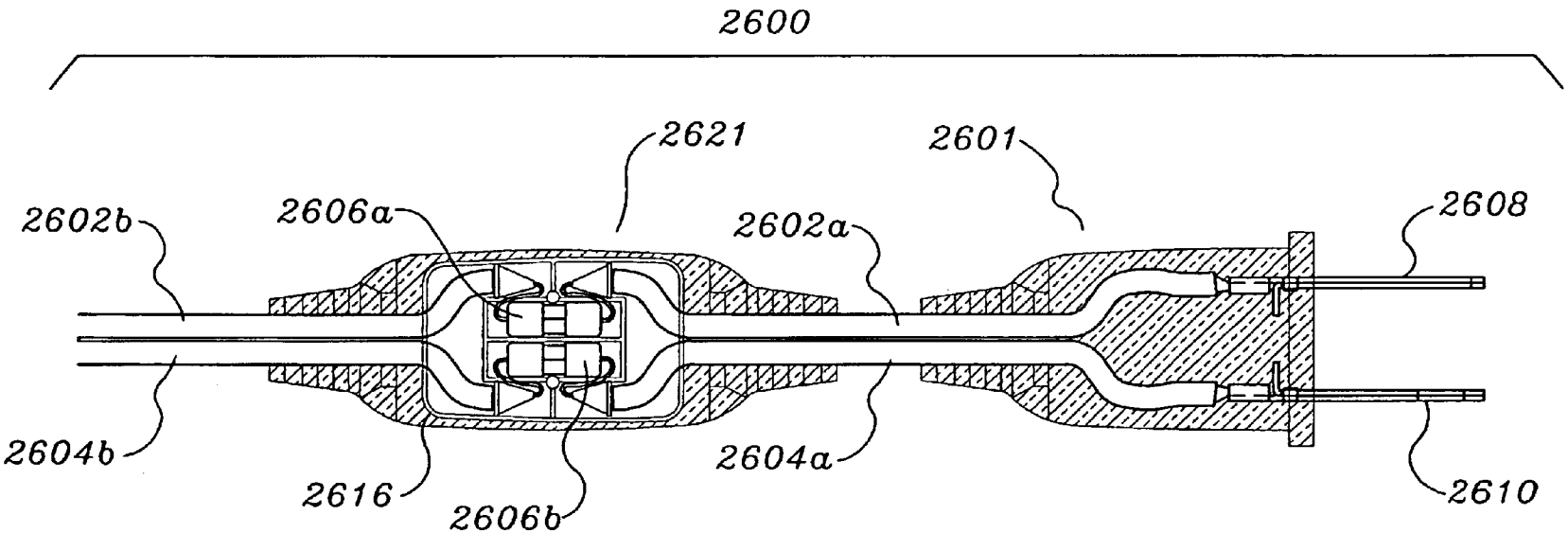
FIG. 26 illustrates a further exemplary embodiment of the present invention

FIG. 26 illustrates an exemplary embodiment of safety device 2600. Safety device 2600 is similar to the embodiment described in FIG. 25, however, there is at least one additional non-replaceable circuit interrupter in the housing. As shown, safety device 2600 is comprised of a conventional type plug 2601 having at least two terminals 2608 and 2610 connected to conductors 2602*a* and 2604*a*. Conductors 2602*a* and 2604*a* exit conventional type plug 2601 and enter housing 2621. Conductors 2602*a* and 2604*a* are coupled to one end non-replaceable circuit interrupter 2606*a* and 2606*b*, respectively, with the second ends coupled to conductors 2602*b* and 2604*b*. Conductors 2602*b* and 2604*b* then exit housing 2621 and are ultimately connected to other down stream components or devices (not shown). Preferably, housing 2621 is located proximate conventional type plug 2601 in order to add safety to substantially all of the cord set. Housing 2621 may be constructed from components similar to those described in FIG. 25 including more than one non-replaceable circuit interrupter 2606*a* and 2606*b* disposed in housing body 2616.

Figure 27B:
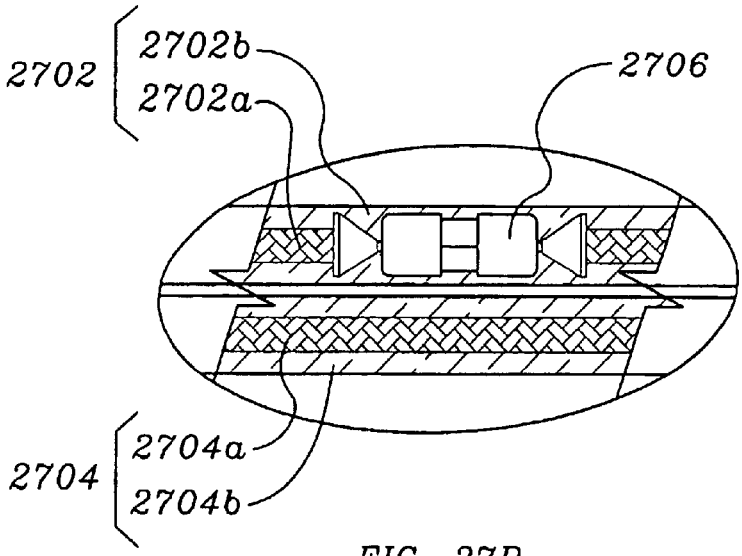
FIGS. 27A and 27B illustrates still a further exemplary embodiment of the present invention.
Figure 27A:
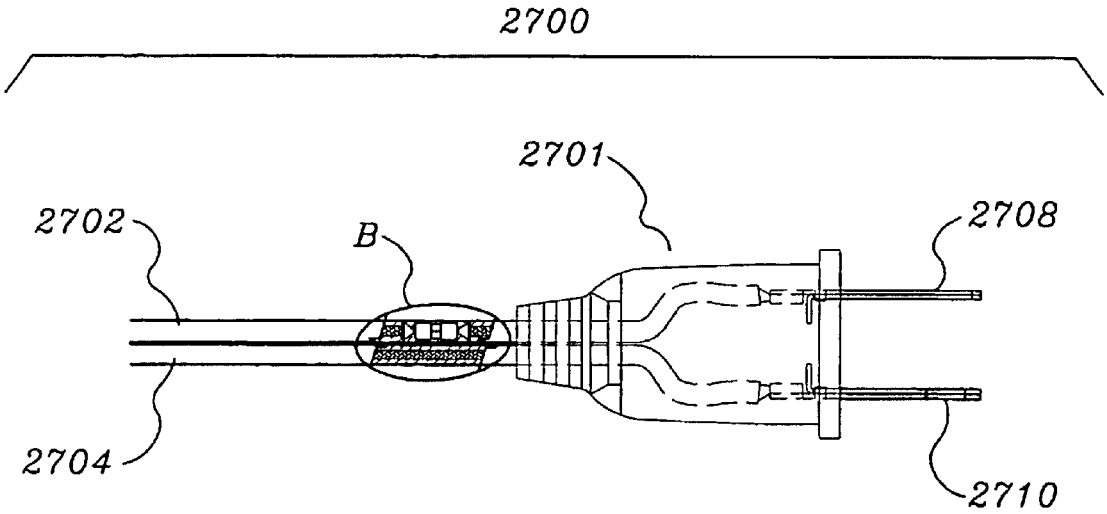

FIGS. 27A and 27B illustrate a partial section of an exemplary embodiment of safety device 2700. Safety device 2700 is similar to other embodiments described above with respect to FIGS. 1–22C, the non-replaceable circuit interrupter, however, is located within a portion of the cord set. As shown, safety device 2700 is comprised of a conventional type plug 2701 having at least two terminals 2708 and 2710 connected to conductors 2702 and 2704, respectively. Conductors 2702 and 2704 exit conventional type plug 2701. As shown, non-replaceable circuit interrupter 2706 is disposed within and in series with one of conductor 2702 or 2704, preferably proximate conventional type plug 2701, in order to add safety to substantially all of the cord set.

As shown in FIG. 27B, non-replaceable circuit interrupter 2706 is connected in series with conductor wire 2702*a*. Although non-replaceable circuit interrupter 2706 is shown having a physical size that allows it to reside completely within conductor insulative cover 2702*b*, the invention is not so limited. It is contemplated that the size of non replaceable circuit interrupter 2706 may require additional space beyond the size of conductor insulative cover 2702*b*, necessitating the use of a housing (such as housing 2521, best sown in FIG. 25).

Figure 28B:
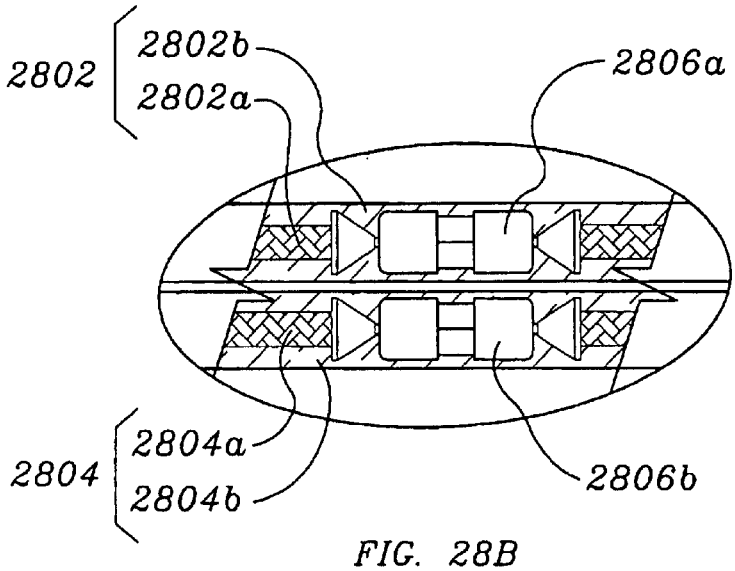
FIGS. 28A and 28B illustrate yet a further exemplary embodiment of the present invention.
Figure 28A:
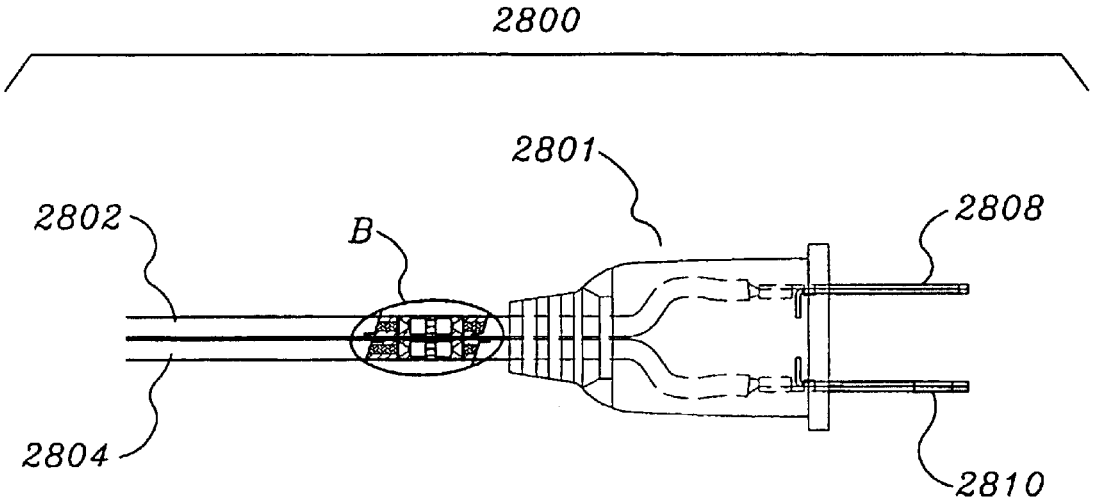

FIGS. 28A and 28B illustrate a partial section of exemplary embodiment of safety device 2800. Safety device 2800 is similar to the embodiment described above with respect to FIGS. 27A and 27B, however, there is at least one additional non-replaceable circuit interrupter in the cord set. As shown safety device 2800 is comprised of a conventional type plug 2801 having at least two terminals 2808 and 2810 connected to conductors 2802 and 2804. Conductors 2802 and 2804 exit conventional type plug 2801. As shown, non-replaceable circuit interrupter 2806*a* and non-replaceable circuit interrupter 2806*b* are disposed within and in series with respective ones of conductors 2802 and 2804, preferably proximate conventional type plug 2801, in order to add safety to substantially all of the cord set.

As described herein, a safety device is provided for an electrical apparatus. The complete apparatus electrical circuit is protected by the non-replaceable circuit interrupter located within, and/or proximate the cord set plug. The cord set plug being utilized to connect the electrical apparatus to a power source (e.g., wall receptacle). The complete apparatus electrical circuit being defined as all of the electrical components (including the cord set) and subsequent electrical circuits of the electrical apparatus. As described, a properly sized non-replaceable circuit interrupter can substantially reduce the duration and/or magnitude of compromised safety caused by an electrical fault which may occur within the complete electrical circuit of the electrical apparatus. The present invention substantially increases the safety redundancy of the electrical apparatus at a cost that is both feasible for the manufacturer and attractive to the consumer.

As described herein, a safety device is provided for an electric apparatus, for example, in the form of a fused cord set plug. The fuse in the fused cord set plug is non-replaceable. As such, the electric apparatus may not be immediately re-energized after a fault because the fuse in the fused cord may not simply be replaced.

The safety device of the present invention may also include a flexible extension cord coupled to either or both ends of the cord set.

By using the safety device (e.g., including a fused cord set plug) of the present invention, a series redundancy may be added to an appliance or electrical device. In such a series redundancy, elements such as a fused cord set plug become "blocking elements." Such a system can substantially reduce failure rates. When a fault occurs in any of the system components (including the electric apparatus, cord, and safety device/cord set plug), if the fault causes a current draw that exceeds the time-current response of the safety device (e.g., fuse element), the fuse acts in its series redundancy capacity.

As described herein, a housing (e.g., a housing including a housing body and a housing cover) may be included in the safety device in order to house electrical connections and a non-replaceable circuit interrupter (e.g., a fuse). For example, the housing may have a one piece folding construction (e.g., see FIGS. 11A–11D). Alternatively, the housing may have a mold encapsulated construction (e.g., see FIGS. 12A–12D). Further still, the housing may be eliminated from the construction of the safety device (e.g., see FIGS. 13A–13D).

As described herein, a cover (e.g., an over mold cover) may be included in the safety device of the present invention. For example, the cover may have a one piece hinged construction (e.g., see FIGS. 14*a*–14*e*). Alternatively, the cover may have a two piece sealed (e.g., permanently closed) construction (e.g., see FIGS. 15*a*–15*e*). Further still, the cover may have a partial over mold construction (e.g., see FIGS. 16*a*–16*d*).

Various exemplary configurations for providing a circuit interrupter that is non-replaceable have been described herein. For example, the circuit interrupter (e.g., fuse) may be sealed in an enclosure such that the safety device (e.g., cord plug) is significantly destroyed if the interrupter is to be accessed. Alternatively, the circuit interrupter may be permanently attached to its respective wire/conductor.

Various sealed enclosure designs have been disclosed herein. For example, the one piece hinged construction, a two piece construction (e.g., the two pieces may snap together, may slidingly engage with one another, etc.), one piece molded construction, or multiple piece constructions. Exemplary methods of sealing the enclosure include sonic welding, adhesive sealing, plastic mold over, permanent snap designs (plug destroyed if "un-snapped"), and fasteners (e.g., rivets (integral with enclosure and separate from the enclosure); tamper proof screws).

If the circuit interrupter is permanently attached to its respective wire/conductor, exemplary methods of making the permanent connection include direct soldering, sonic welding, conductive adhesives, and crimps.

Although the non-replaceable circuit interrupter of the present invention has been described primarily by reference to a fuse (e.g., slow-blow, fast-blow, etc.), it is not limited thereto. For example, the circuit interrupter may be a non-resettable circuit interrupter, a resettable circuit interrupter, and an arc-fault circuit interrupter. Further still, the safety device may include two or more circuit interrupters (e.g., one circuit interrupter between a first terminal and a positive conductor of the cord set, and a second circuit interrupter between a second terminal and a neutral conductor of the cord set). The circuit interrupter may be any of a number of devices so long as the circuit interrupter is non-replaceable within the safety device. As such, after the circuit interrupter has activated based on an overcurrent (e.g., blown, tripped, etc.), the entire safety device (e.g., electrical plug, electrical plug and cord, etc.) may be replaced in order to use the electric apparatus (e.g., electric fan, etc.).

Although certain features of the present invention (e.g., inclusion of an over mold cover, transparent/translucent over mold cover, transparent/translucent housing body/housing cover, hinged housing body/housing cover, mold encapsulated housing, no housing (inclusion of alignment cavities), sealed mating surface, partial over mold cover, thermal reactive housing/box cover, LED indicator) have been illustrated and described in certain configurations, the present invention is not limited thereto. Each of these (and other disclosed features) may be included in any of the alternative embodiments, or in a non-illustrated configuration.

Although the electric apparatus with which the safety device of the present invention is used had been primarily described in terms of a motor, it is not limited thereto. For example, the electric apparatus could be a light, a series of lights (e.g., Christmas or holiday lights), a variable load, or a multi-speed motor. As such, the electric apparatus could be any device that may be protected by the safety device of the present invention. Further, although the exemplary embodiments are illustrated as having a substantially rectangular shape, the invention is not so limited. It is also contemplated that the invention may take the form of a plug or receptacle having a substantially circular shape if desired, as well as any other geometric shape.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A safety device for use with an electric apparatus, the safety device comprising:

a housing;

at least two terminals disposed at least partially within the housing;

a cord set having at least two conductors, a first end of the two conductors mounted at least partially within the housing;

a non-replaceable circuit interrupter disposed within the housing so as to be inaccessible to a user and coupled between i) one of the at least two terminals and ii) one of the at least two conductors of the cord set; and at least one control component electrically connected to one of the at least two conductors.

2. The safety device according to claim 1, wherein at least a portion of the at least two conductors are coupled between the first housing and a second housing located proximate the first housing; and the at least one additional control component is disposed within the second housing for controlling an operation of the electrical apparatus.

3. The safety device according to claim 1, wherein the at least one control component comprises at least one of:

i) a switch;

ii) a timer;

iii) a transformer;

iv) a passive electrical device;

v) an active electrical device; and vi) a circuit breaker.

4. The safety device according to claim 1, wherein the non-replaceable circuit interrupter is one of i) a non-ressetable circuit interrupter, ii) an arc-fault circuit interrupter, and iii) a resettable circuit interrupter.

5. The safety device according to claim 1, wherein the non-replaceable circuit interrupter is a fuse.

6. The safety device according to claim 5, wherein the fuse is one of a i) a slow-blow fuse, ii) a fast-blow fuse.

7. The safety device according to claim 1, wherein a rating of the non-replaceable circuit interrupter is based on at least one of:

an inrush current of the electrical apparatus, a steady state load of the electrical apparatus, load spikes based on operational conditions of the electrical apparatus, and an auto transformer effect of the electrical apparatus.

8. The safety device according to claim 1, wherein the electrical apparatus comprises one of:

at least one motor, wherein the motor is one of i) a single speed motor, ii) a multi speed motor, and iii) a variable speed motor at least one light; and a plurality of series connected lights.

9. The safety device according to claim 1, wherein the non-replaceable circuit interrupter is electrically coupled between i) one of the at least two terminals and ii) one of the at least two conductors of the cord set.

10. The safety device according to claim 1, wherein the non-replaceable circuit interrupter is electrically and physically coupled between i) one of the at least two terminals and ii) one of the at least two conductors of the cord set.

11. The safety device according to claim 1, further comprising means for determining a status of the non-replaceable circuit interrupter.

12. The safety device according to claim 1, wherein the at least one control component is disposed within the housing for controlling an operation of the electrical apparatus.

13. The safety device according to claim 12, wherein the at least one control component is coupled between a power source and the non-replaceable circuit interrupter.

14. The safety device according to claim 12, wherein the non-replaceable circuit interrupter is coupled between a power source and the at least one control component.

15. A safety device for use with an electric apparatus, the safety device comprising:

a first housing;

at least two terminals disposed at least partially within the first housing;

a cord set having at least two conductors, a first end of the at least two conductors mounted at least partially within the first housing, the at least two conductors connected to the at least two terminals and exiting the first housing;

a second housing located proximate the first housing, the at least two conductors coupled between the first housing and the second housing; and a non-replaceable circuit interrupter disposed within the second housing so as to be inaccessible to a user and connected in series with at least one of the at least two conductors of the cord set.

16. The safety device according to claim 15, wherein the non-replaceable circuit interrupter includes at least two non-replaceable circuit interrupters, a first one of the non-replaceable circuit interrupters electrically connected in series with one of the at least two conductors of the cord set, and a second of the non replaceable circuit interrupters electrically connected in series with a further one of the at least two conductors of the cord set.

17. The safety device according to claim 15, further comprising at least one of:

i) a transparent portion in the second housing to permit viewing of a status of the non-replaceable circuit interrupter, ii) a portion of the second housing comprising a polymer reactive to a thermal condition of the non-replaceable circuit interrupter, and iii) an illumination device coupled to the non replaceable circuit interrupter and disposed within the second housing to indicate a status of the non-replaceable circuit interrupter.

18. A safety device for use with an electric apparatus, the safety device comprising:

a housing;

at least two terminals disposed at least partially within the housing;

a cord set having at least two conductors, a first end of the at least two conductors mounted at least partially within the housing and connected to respective ones of the at least two terminals, the at least two conductors exiting the housing; and a non-replaceable circuit interrupter i) located proximate the housing, ii) disposed within a portion of the cord set and iii) connected in series with one of the at least two conductors of the cord set;

wherein the non-replaceable circuit interrupter is disposed within the cord set so as to be inaccessible to a user.

19. The safety device according to claim 18, wherein the non-replaceable circuit interrupter includes at least two non-replaceable circuit interrupters, a first one of the non-replaceable circuit interrupters electrically connected in series with one of the at least two conductors of the cord set, and a second of the non replaceable circuit interrupters electrically connected in series with a further one of the at least two conductors of the cord set.

20. A method for enhancing the safety of an electrical apparatus, the method comprising the steps of:

providing a non-replaceable circuit interrupter one of within and proximate a cord set plug for connecting the electrical apparatus to a source of power, the non-replaceable circuit interrupter coupled between the source of power and the electrical apparatus; and determining a size of the non-replaceable circuit interrupter based on a load characteristic of the electrical apparatus, wherein a time period and/or magnitude of compromised safety caused by an electrical fault occurring at least one of i) between said non-replaceable circuit interrupter and said electrical apparatus and ii) within said electrical apparatus is reduced.

* * * * *